US007938588B2

(12) United States Patent
Yokoyama

(10) Patent No.: US 7,938,588 B2
(45) Date of Patent: May 10, 2011

(54) THERMAL PRINTER HAVING FIRST AND SECOND RING-LIKE CONVEYANCE PATHS

(75) Inventor: Yoshimasa Yokoyama, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 760 days.

(21) Appl. No.: 11/899,594

(22) Filed: Sep. 6, 2007

(65) Prior Publication Data

US 2008/0056793 A1 Mar. 6, 2008

(30) Foreign Application Priority Data

Sep. 6, 2006 (JP) ..... 2006-241730

(51) Int. Cl.

| | |
|---|---|
| ***B41J 29/38*** | (2006.01) |
| ***B41J 17/32*** | (2006.01) |
| ***B41J 13/00*** | (2006.01) |
| ***B41J 29/00*** | (2006.01) |

(52) U.S. Cl. ..... 400/76; 400/120.01; 400/703; 347/213; 347/218; 347/222

(58) Field of Classification Search ..... 400/120.04, 400/120.01; 347/176, 218, 222
See application file for complete search history.

(56) References Cited

U.S. PATENT DOCUMENTS

| | | | | |
|---|---|---|---|---|
| 4,789,872 | A * | 12/1988 | Hosoi | 347/175 |
| 5,115,255 | A * | 5/1992 | Kobayashi et al. | 347/180 |
| 5,249,873 | A | 10/1993 | Okunomiya et al. | |
| 6,069,642 | A | 5/2000 | Isobe | |
| 6,097,497 | A * | 8/2000 | McGraw | 358/1.12 |
| 7,030,897 | B2 * | 4/2006 | Matsukawa | 347/212 |
| 2002/0051027 | A1 * | 5/2002 | Kyogoku et al. | 347/19 |
| 2005/0093959 | A1 | 5/2005 | Kitamura | |
| 2007/0081069 | A1 | 4/2007 | Kitamura | |

FOREIGN PATENT DOCUMENTS

| | | | |
|---|---|---|---|
| EP | 0 521 521 | A2 | 1/1993 |
| GB | 2 312 650 | A | 11/1997 |
| JP | 63135270 | A * | 6/1988 |
| JP | 03104674 | A * | 5/1991 |
| JP | 05112043 | A * | 5/1993 |
| JP | 8-310067 | A | 11/1996 |
| JP | 10-44556 | A | 2/1998 |
| JP | 10-181122 | A | 7/1998 |

OTHER PUBLICATIONS

Soma, Utami Publication No. JP 2004-347927, Image forming apparatus and manufacturing method for the same Machine translation of detailed description.* International Search and Written Opinion of the International Searching Authority for PCT/JP2007/067545, dated Nov. 26, 2007. 11 Sheets.

* cited by examiner

*Primary Examiner* — Daniel J Colilla
(74) *Attorney, Agent, or Firm* — Holtz, Holtz, Goodman & Chick, PC

(57) ABSTRACT

A size-reduced printer that conveys a recording sheet in a circulating manner along a ring-like conveyance path while printing a plurality of images on the recording sheet in different colors sequentially in a superimposed manner, thereby forming a full color image. When a ribbon cassette that contains a multi-color ink ribbon is loaded at a predetermined position within a printer housing, a ring-like conveyance path is formed between the ribbon cassette and the printer housing. While the thermal head is driven and the recording sheet is conveyed once in a circulating manner along the conveyance path, a one-color image is printed on a previous printed one-color image in a superimposed manner in a corresponding one of the different color inks of the multi-color ink ribbon, thereby forming a full color image finally.

6 Claims, 16 Drawing Sheets

THERMAL PRINTER HAVING FIRST AND SECOND RING-LIKE CONVEYANCE PATHS

BACKGROUND OF THE INVENTION

1. Field of the Invention

The present invention relates to printers that print a full color image in a plurality of colors and more particularly to such color printer having a reduced size.

2. Background Art

Generally, thermal printers comprise a thermal head that has a heating device and a conveyance device that conveys a recording sheet and a film-like ink ribbon coated with an ink. In the thermal printer, the ink ribbon is loaded between the recording sheet and the thermal head such that an ink of the ink ribbon is transferred to the recording sheet by the thermal head that is driven in accordance with print data, thereby forming an image. Especially, in a color thermal printer, a multi-color ink ribbon with yellow, magenta and cyan inks is used to print a image sequentially in yellow, magenta cyan inks in an superimposed manner, thereby printing a full color image.

In the past, there are various thermal printers that print a color image with a multi-color ink ribbon. For example, Unexamined Japanese Patent Application KOKAI Publication No. H10-181122 discloses a printer (of a first type) that comprises conveyance rollers that convey a recording sheet along a conveyance path in one and the other directions and a thermal head disposed at a predetermined position in the vicinity of the conveyance path to print a full color image with a multi-color ink ribbon on a recording sheet. The printer of this type conveys the recording sheet in one direction while printing an image in one color ink of multi-color ink ribbon, and, when this printing ends, conveys the printing sheet in the opposite direction to the print start position. Such operation is repeated in each of the different inks of the ribbon, thereby forming a full color image.

Unexamined Japanese Patent Application KOKAI Publication No. H10-44556 discloses a printer (of a second type) which comprises a platen drum around which a recording sheet is wound, and a thermal head disposed at a predetermined position in the vicinity of the outer periphery of the platen drum. This printer causes the platen drum to make three rotations in a predetermined direction to print yellow, magenta and cyan images sequentially in this order in an superimposed manner on a recording sheet around the platen drum in the yellow, magenta and cyan inks contained in the ink ribbon.

Unexamined Japanese Patent Application KOKAI Publication No. H8-310067 discloses a printer (of a third type) which includes a ring-like conveyance path along which a recording sheet is conveyed, and a thermal head and a multi-color ink ribbon disposed outside the outer periphery of the conveyance path. In this printer, the recording sheet is conveyed in one direction in a circulating manner along the conveyance path with its recording surface facing the outside of the ring-like conveyance path. Each time the recording sheet passes through a printing position where the thermal head is disposed, an image is printed in a respective one of the different color inks contained in the ink ribbon in a superimposed manner on a previous image printed on the recording sheet. Such printing is repeated so as to form a full color image.

In the printer of the first type, each time one-color printing is terminated, the recording sheet is required to be conveyed back to the print start position to start to print a next image in a different color. Thus, it takes a relatively long time until a full color image has been printed.

In the printer of the second type, since the recording sheet is wound around the outer periphery of the platen drum, the platen drum is required to have such a relatively large diameter that the outer periphery of the drum corresponds in length to the recording sheet. In addition, the platen drum is required to be finished with high dimension accuracy, which increases the cost. Further, clamps are required which fix an end of the recording sheet to be wound around the outer periphery of the platen drum to the platen drum, which renders the structure complicated. Since the recoding sheet is clamped at one end to the platen drum, that end portion of the sheet does not contribute to the printing of the image or is wastefully used.

In the printer of the third type, the recording sheet is circulated in one direction and not conveyed between the two positions as in the printer of the first type, and hence the printing time is reduced. In the printer of the third type unlike that of the second type, neither a large-diameter platen drum whose outer periphery corresponds in length to the recording sheet nor clamps for the recording sheet are required to be provided. Thus, the printer of the third type is simplified in structure and reduced in cost compared to the printer of the second type.

In the printer of the third type, however, the thermal head, disposed outside the ring-like conveyance path, prints an image on the recording surface of the recording sheet that is conveyed along the conveyance path in a circulating manner with the recording face facing the outside of the conveyance path. Thus, in addition to the thermal head, the mechanism that moves the thermal head between its printing position and non-printing position, the ribbon cassette that contains the multi-color ink ribbon and the ribbon take-up shaft that takes up a used multi-color ink ribbon are disposed outside the ring-like conveyance path. This increases the size of the whole printer.

SUMMARY OF THE INVENTION

It is therefore an object of the present invention to provide a size-reduced printer which sequentially prints different-color images in a superimposed manner on a recording sheet that is conveyed in a circulating manner along the ring-like conveyance path, thereby forming a full color image.

In order to achieve the above object, the present invention provides a printer comprising: means for forming within a housing of the printer a ring-like conveyance path through which a recording sheet is conveyed; a conveyance unit for conveying the recording sheet a plurality of times in one direction along the conveyance path with a recording face of the recording sheet facing the inside of the ring-like conveyance path; and a printing unit including a thermal head disposed within the inside of the ring-like conveyance path for driving the thermal head to print images in different colors in a superimposed manner on the recording face of the recording sheet in such a manner that the printing unit prints a respective image on the recording sheet face while the recording sheet is once conveyed in a circulating manner through the conveyance path.

According to the present invention, since the thermal head is disposed within the inside of the ring-like conveyance path along which the recording sheet is conveyed in a circulating manner, the inside of the ring-like conveyance path is available effectively. Thus, the printer is reduced in size compared to that in which the thermal head is disposed on the opposite side of the ring-like conveyance path from the inside of the ring-like conveyance path.

According to another aspect of the present invention, the printer has a ribbon cassette receiving space, within the inside of the ring-like conveyance path, where a ribbon cassette which contains a multi-color ink ribbon with a plurality of different color areas is loaded. While the recording sheet is once conveyed in the circulating manner through the conveyance path by the conveyance unit, the printing unit drives the thermal head to print the image in an ink contained in a respective one of the plurality of different ink areas of the multi-color ink ribbon contained in the cassette loaded in the ribbon cassette receiving space within the inside of the ring-like conveyance path, thereby forming the full color image.

According to another aspect of the present invention, the means for forming a conveyance path forms the conveyance path between the housing and the cassette loaded in the cassette receiving space.

According to another aspect of the present invention, the recording sheet comprises a heat-sensitive recording sheet with a laminate of different coloring layers provided on the recording face of the sheet and arranged to be colored at corresponding temperatures. The printing unit drives the thermal head to color a respective one of the different coloring layers of the laminate provided on the recording face of the recording sheet each time the recording sheet is conveyed once along the conveyance path by the conveyance unit, thereby forming the full color image. The printer further comprises: an optical fixing unit provided in an optical unit receiving space within the inside of the ring-like conveyance path for optically fixing the respective coloring layers colored on the recording sheet by the thermal head.

According to another aspect of the present invention, the means for forming a ring-like conveyance path forms the conveyance path between the housing and the optical fixing unit loaded in the optical unit receiving space.

According to another aspect of the present invention, the conveyance path comprises a first conveyance path part corresponding in length to the first recording sheet in the conveyance direction and a second conveyance path part corresponding in length to a second recording sheet longer than the first recording one, the first and second conveyance path parts having a path portion common thereto. The printer further comprises a selector for selecting one of the first and second conveyance path parts depending on whether the recording sheet to be used is the first or second recording sheet. The thermal head is disposed at the path portion common to the first and second conveyance path parts within the inside of the ring-like conveyance path.

According to another aspect of the present invention, the first and second recording sheets each have identification information affixed to the recording sheet to identify the same. The printer further comprises a sensor for sensing the identification information affixed to the first or second recording sheet inserted into the printer. The selector automatically selects an appropriate one of the first and second conveyance path parts depending on the identification information sensed by the sensor.

According to another aspect of the present invention, a ribbon cassette which contains a multi-color ink ribbon with a plurality of different color areas is loaded in the inside of the first and second conveyance path parts. When the recording sheet sensor senses the first recording sheet, the printing unit drives the thermal head to sequentially print images on the first recording sheet in a superimposed manner with the plurality of different ink areas of the multi-color ink ribbon contained in the cassette in such a manner that one-color image may printed on the first recording sheet while the first recording sheet is once circulated through the first conveyance path part by the conveyance unit, thereby forming the color image. When the recording sheet sensor senses the second recording sheet, the printing unit drives the thermal head to sequentially prints images on the second recording sheet in a superimposed manner with the plurality of different ink areas of the multi-color ink ribbon contained in the cassette. In this case, one-color image is printed on the second recording sheet while the second recording sheet is once circulated through the second conveyance path part by the conveyance unit, thereby forming the color image.

According to another aspect of the present invention, the printer has a ribbon cassette receiving space where either of a first and a second ribbon cassette is loaded selectively. The first cassette contains a multi-color ink ribbon with a plurality of different ink areas which correspond in length to the first recording sheet and having cassette information affixed thereto to identify the first cassette. The second ribbon cassette contains a multi-color ink ribbon with a plurality of different color ink areas which correspond in length to the second recording sheet and having second cassette information affixed thereto to identify the second cassette. The printer further comprises a cassette information sensor for sensing the cassette information affixed to the cassette loaded in the ribbon cassette receiving space.

According to another aspect of the present invention, the printer further comprises a determiner for determining whether or not a combination of the recording sheet whose affixed information is sensed by the sheet sensor and the cassette whose affixed information is sensed by the cassette information sensor is proper. If so, the selector automatically selects an appropriate one of the first and second conveyance path parts for conveying the recording sheet based on the information sensed by the recording sheet sensor.

According to another aspect of the present invention, the selector comprises a manually operated one. The printer further comprises a determiner for determining whether or not a combination of the recording sheet whose affixed information is sensed by the sheet sensor and the cassette whose affixed information is sensed by the cassette sensor is proper; and an indicator, responsive the determining that the combination of the sheet and the cassette is proper, for indicating which of the first and second conveyance path parts should be selected.

According to another aspect of the present invention, the printer further comprises a determiner for determining whether or not a combination of the recording sheet whose affixed information is sensed by the sheet sensor and the cassette whose affixed information is sensed by the cassette sensor is proper; and a notifier, responsive the determining that the combination of the sheet and the cassette is not proper, for notifying this fact.

According to another aspect of the present invention, the printer further comprises an operating element manually operated to operate the switching member for selecting one of the first and second conveyance path parts.

According to another aspect of the present invention, the conveyance unit comprises a pair of rollers provided in the vicinity of the conveyance path for feeding the recording sheet while holding the recording sheet therebetween. The pair of rollers comprises a drive roller driven by a drive motor and provided on the opposite side of the recording sheet from its recording face and a follower roller rotated by the drive roller and provided on the side of the recording face of the recording sheet.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE INVENTION

Figure 1:
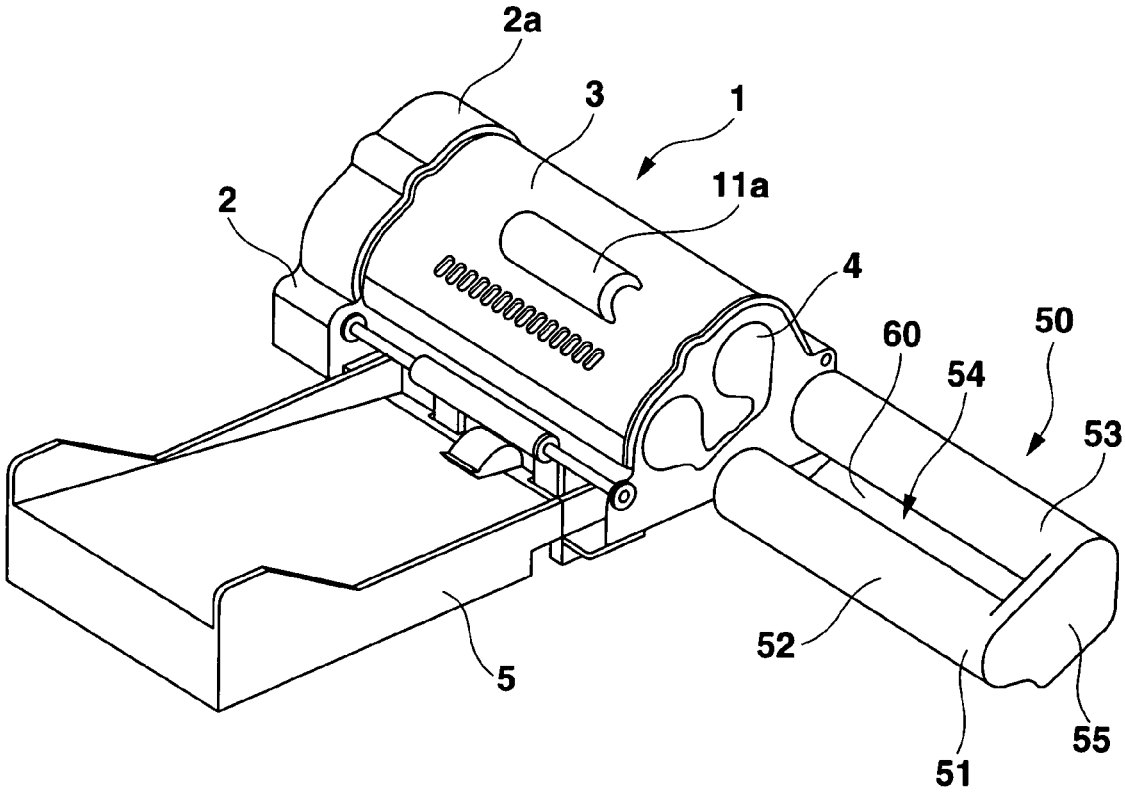
FIG. 1 is a perspective view of a printer of a first embodiment according to the present invention.
Figure 2:
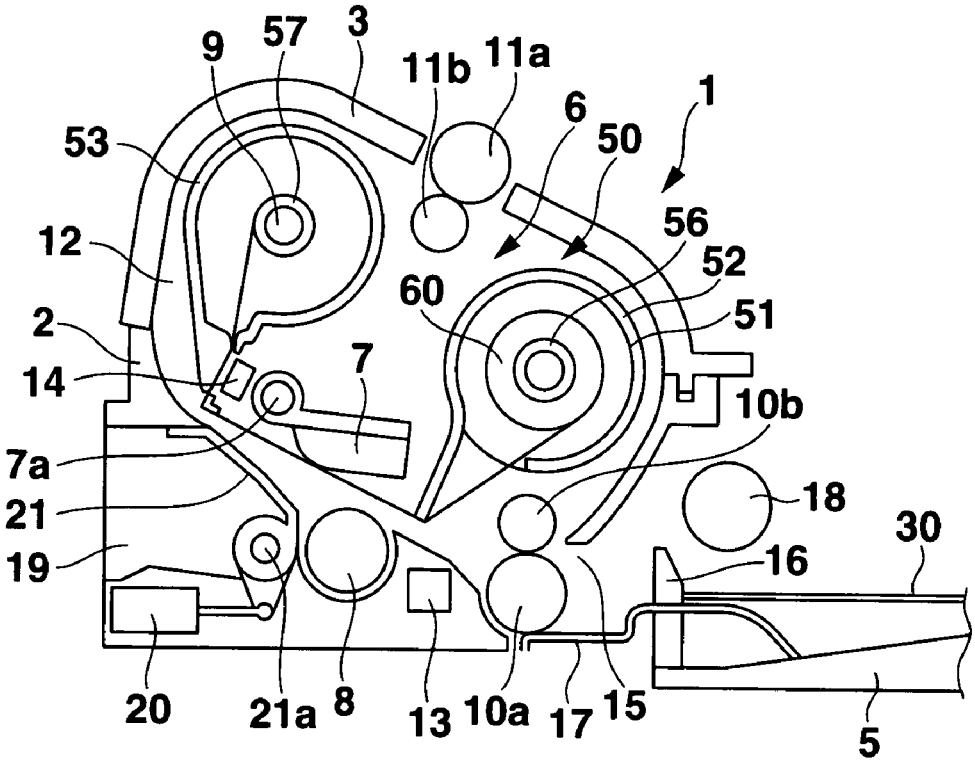
FIG. 2 is a schematic cross section view of the printer.

Referring to the drawings, the printers of the embodiments according to the present invention will be described. FIG. 1 is a perspective view of a printer of a first embodiment of the present invention, and FIG. 2 is a schematic cross section view of the printer. This printer is a thermal transfer printer that causes a postal card- or L-sized photographic (or recording) sheet to be conveyed along a ring-like path a plurality of times such that a like number of different-colored images are sequentially printed in a superimposed manner on the sheet in a like number of different color inks contained in a multi-color ink ribbon. As shown in FIG. 1, the printer has a housing 1 which comprises a printer body 2 and a cover 3. The housing 1 has a cassette inlet 4 on one side thereof through which a ribbon cassette 50 that contains the multi-color ink ribbon 60 is insertable into the housing 1.

The ribbon cassette 50 inserted through the cassette inlet 4 into the housing 1 is loaded in a ribbon cassette receiving space 6 provided at a predetermined position within the housing 1. Also provided in the ribbon cassette receiving space 6 within the housing 1 are a thermal head 7 and a platen roller 8 that cooperate to print an image on the recording sheet 30, and a ribbon take-up shaft 9 that takes up a part of the multi-color ink ribbon 60 used in the thermal transfer process. Also provided within the housing 1 are a first pair of conveyance rollers 10*a* and 10*b* and a second pair of conveyance rollers 11*a* and 11*b* to convey the recording sheet 30. The rollers 10*a* and 11*a* are drive ones driven by a motor (not shown) and the rollers 10*b* and 11*b* are follower rollers rotated by the drive rollers 10*a* and 11*a*, respectively.

When the ribbon cassette 50 is received in the ribbon cassette receiving space 6 within the housing 1, a ring-like gap, which functions as a conveyance path 12 through which the recording sheet 30 is conveyed, is formed between the housing 1 and a ribbon cassette housing 51 loaded within the housing 1. The recording sheets 30 to be used are postal-card-sized (100 mm×148 mm) and L-sized (89 mm×127 mm) ones. The length of the ring-like conveyance path 12 is somewhat larger than the length of a longer side of the larger, or postal card-sized, recording sheet in the conveyance direction (148 mm).

Figure 4:
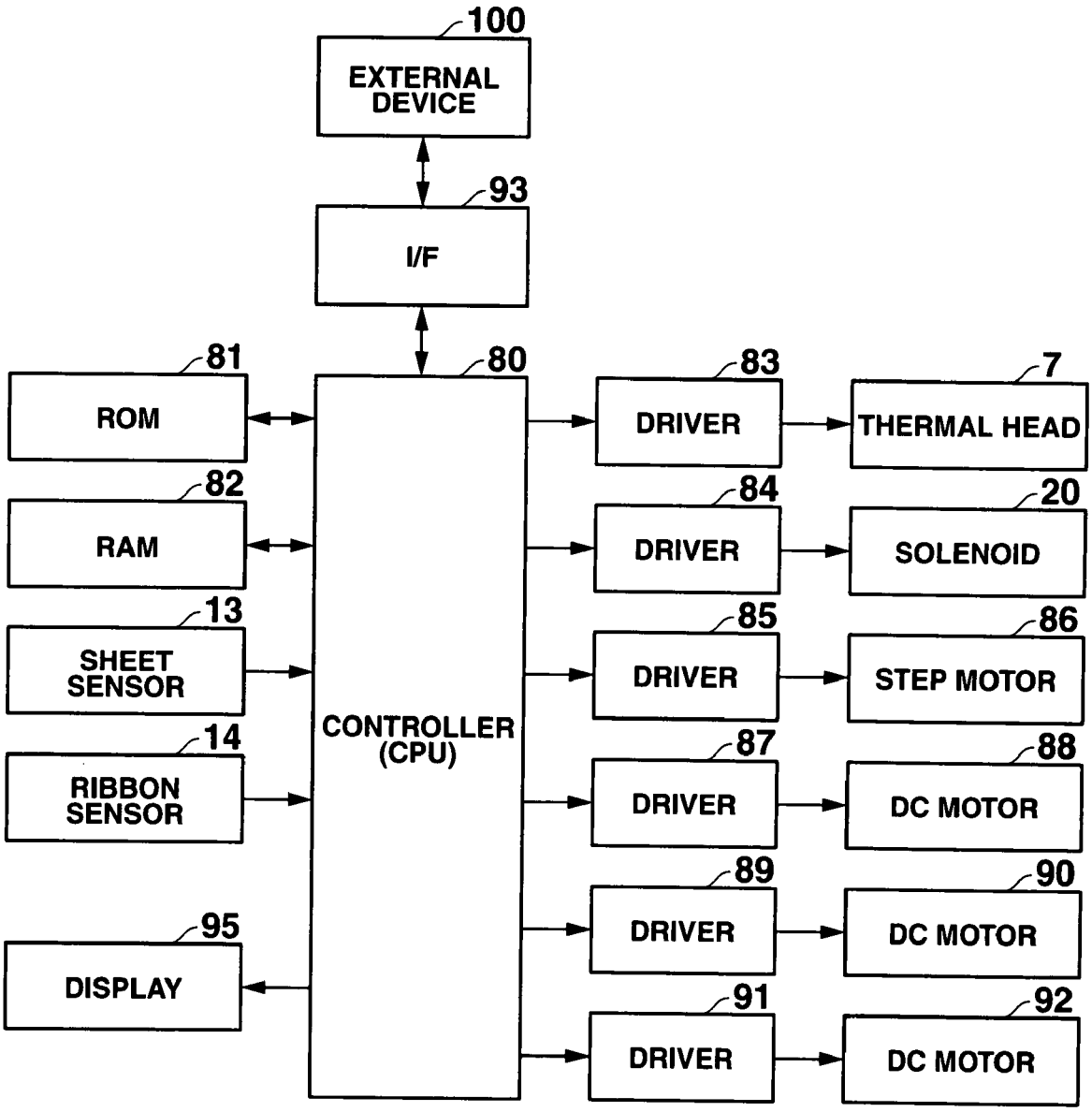
FIG. 4 is a block diagram of an electronic circuit of the printer.

The thermal head 7 and the platen roller 8 are disposed in opposite relationship between which the conveyance path 12 extends. The first and second pairs of rollers 10*a*, 10*b* and 11*a*, 11*b* each are disposed likewise in opposite relationship. More particularly, the thermal head 7, the follower rollers 10*b* and 11*b*, and the ribbon take-up shaft 9 are disposed within the inside of the ring-like conveyance path 12 whereas the platen roller 8 and the drive rollers 10*a* and 11*a* are disposed outside the ring-like conveyance path 12. The platen roller 8 and the drive rollers 10*a* and 11*a* are driven by a step motor 86 (FIG. 4). The thermal head 7 is moved by forwardly and backwardly rotating a motor 88 (FIG. 4) between a printing position where the thermal head 7 comes into contact with the platen roller 8 and a non-printing position where the thermal head 7 is away from the platen roller 8. The ribbon take-up shaft 9 is driven by a DC motor 90 (FIG. 4).

A recording-sheet sensor 13 is provided in the vicinity of the conveyance path 12 to sense a leading end of the recording sheet 30 which is conveyed along the path 12. A ribbon sensor 14 is provided in the vicinity of the conveyance path 12 to detect a head mark provided in each of different-colored ink areas of the multi-color ink ribbon 60, thereby detecting the position of that ink area.

A tray 5 is provided in the vicinity of a sheet inlet 15 provided in the housing 1. A separating pawl 16 that separates recording sheets 30 piled on the tray 5 one by one is provided at an end of the tray 5 nearer the sheet inlet 15. Further, a sheet feed lever 17 is provided which lifts a top one of the recording sheets 30 piled on the tray 5. A pickup roller 18 is provided above the tray 5 to feed the recording sheet 30 separated by the pawl 16 into the printer housing 1. The sheet feed lever 17 lifts a leading end portion of a recording sheet 30 placed on the tray 5 with the aid of a DC motor 92 (FIG. 4) at the start of the printing such that the lifted sheet comes into contact with the pickup roller 18, which is driven by the motor 92.

The printer has a sheet exit 19 on the opposite side thereof from the sheet inlet 15 with a sheet exit gate 21 driven by a solenoid 20 provided at the sheet exit 19. When a recording sheet 30 is printed, the gate 21 is moved to a position where it closes the sheet exit 19 so as to form a part of the outer periphery of the conveyance path, thereby allowing the recording sheet 30 to be conveyed in the circulating manner along the conveyance path 12. When the recording sheet 30 is discharged from the exit 19, the gate 21 is rotated around a shaft 21*a* by the solenoid 20 to open the sheet exit 19, from which the recording sheet 30 is discharged to the outside.

Although not shown, provided within an end 2*a* of the printer remoter from its end where the cassette inlet 4 is provided are a thermal-head moving mechanism that moves the thermal head 7 between the printing position where the thermal head 7 is pressed against the platen roller 8 for printing purposes and a non-printing position where the thermal head 7 is separated from the platen roller 8. Also provided within the printer end 2*a* are a conveyance/drive mechanism that drives the platen roller 8 and the drive rollers 10*a* and 11*a* to convey a recording sheet 30, and a ribbon take-up mechanism that drives a ribbon take-up shaft 9 to take up the ink ribbon 60 around the take-up core 57. A step motor 86 and DC motors 88 and 90 are provided within the printer end 2*a* to drive those mechanisms.

The head moving mechanism comprises a cam (not shown) driven by the DC motor 88 to be engaged with the thermal head 7, thereby swinging the same around a pivot 7*a* between the printing position and the non-position in accordance with forward and backward rotations of the DC motor 88. In the conveyance/drive mechanism, the step motor 86, platen roller 8, and first and second drive rollers 10*a* and 11*a* are driven in respective predetermined directions through a chain of meshing gears having a predetermined gear ratio (not shown). In this case, the gear ratio is selected such that the platen roller 8 and the first and second drive rollers 10*a* and 11*a*, disposed within the inside of the ring-like conveyance path, convey a recording sheet 30 at equal speeds or at equal peripheral speeds. In the ribbon take-up mechanism, driving of the DC motor 90 is transmitted through a chain of gears (not shown) to the ribbon take-up shaft 9. In order to take-up the multi-color ink ribbon 60, the ribbon is fed at a relatively high speed when a head of each ink area is found and at a relatively low speed in printing. The head moving mechanism, conveyance/drive mechanism and ribbon take-up mechanism are generally used in the thermal transfer printer and disposed within the inside of the ring-like conveyance path 12, thereby reducing the size of the printer body.

The ribbon cassette 50 that contains the multi-color ink ribbon 60 has a housing 51, which comprises an unused ribbon case part 52 which encases an unused multi-color ink ribbon 60 and a used ribbon case part 53 which encases a used multi-color ink ribbon 60. These case parts 52 and 53 have a space 54 therebetween in which the thermal head 7 is disposed with a joint 55 which joins the case parts 52 and 53 at their right-hand ends. The case part 52 contains a rotatable ribbon feed core 56 around which an unused multi-color ink ribbon 60 is wound. The case part 53 contains a rotatable ribbon take-up core 57 engaging the ribbon take-up shaft 9 such that a used ink ribbon 60 is taken up around the ribbon take-up core 57 when the ribbon take-up shaft 9 is rotated.

Figure 3:
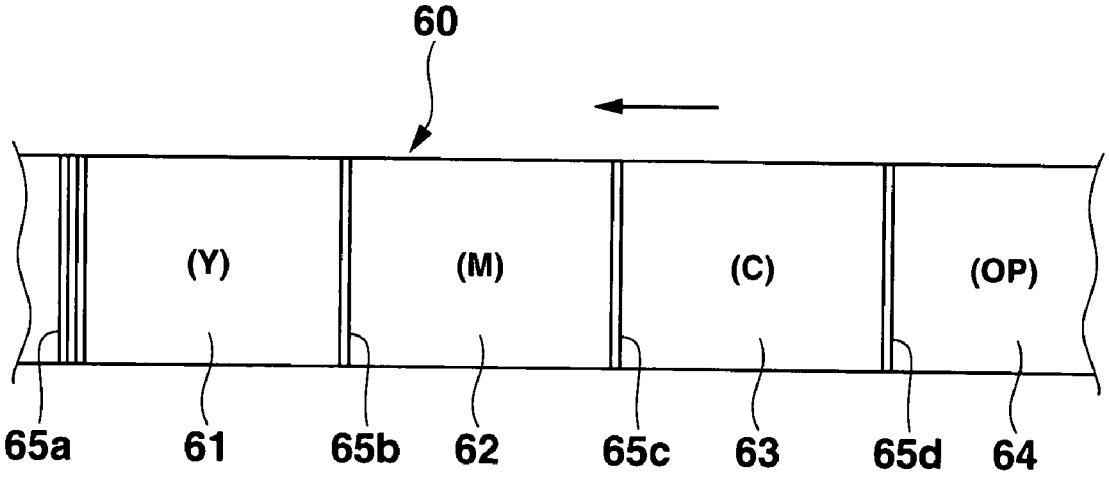
FIG. 3 illustrates an ink ribbon to be used in the printer.

As shown in FIG. 3, the multi-color ink ribbon 60 encased within the ribbon cassette 50 has yellow (Y), magenta (M), cyan (C) and overcoat (OP) ink areas 61-64 disposed repeatedly in this order on the ribbon surface along the length of the ribbon with head marks 65*a*, 65*b*, 65*c* and 65*d* provided at the head positions of the respective ink areas. The overcoat ink area 64 comprises a transparent ink layer which will be transferred to the whole surface of a color image formed in the three color inks of the Y, M and C ink areas 61, 62 and 63 in the superimposed manner on the recording sheet to protect the color image.

FIG. 4 is a block diagram of an electronic circuit of the printer. As shown, the electronic circuit comprises a controller 80, which includes a CPU, connected to a ROM 81 that has stored programs for use in a printing process, a RAM 82 that stores print data received from an external device 100 and data required for the printing process, a driver 83 that causes the thermal head 7 to generate heat in accordance with print data, a driver 84 which drives the solenoid 20 to open/close the sheet exit gate 21, a driver 85 that drives the step motor 86 to actuate the platen roller 8 and conveyance rollers 10*a* and 11*a*, a driver 87 which drives the DC motor 88 to move the thermal head 7 to the platen roller 8, a driver 89 which drives the DC motor 90 that drives the ribbon take-up shaft 9, a driver 91 which drives the DC motor 92 to rotate the take-up roller 18 and the sheet feed lever 17. The controller 80 also is connected through an I/F circuit 93 to the external device 100 to receive print data from the external data 100. The controller 80 also is connected to a display 95 which displays messages and required data, the recording sheet sensor 13 which senses a leading end of the recording sheet 30, and a ribbon sensor 14 which senses the head marks 65*a*, 65*b*, 65*c* and 65*d* affixed to the ink ribbon 60.

Figure 5:
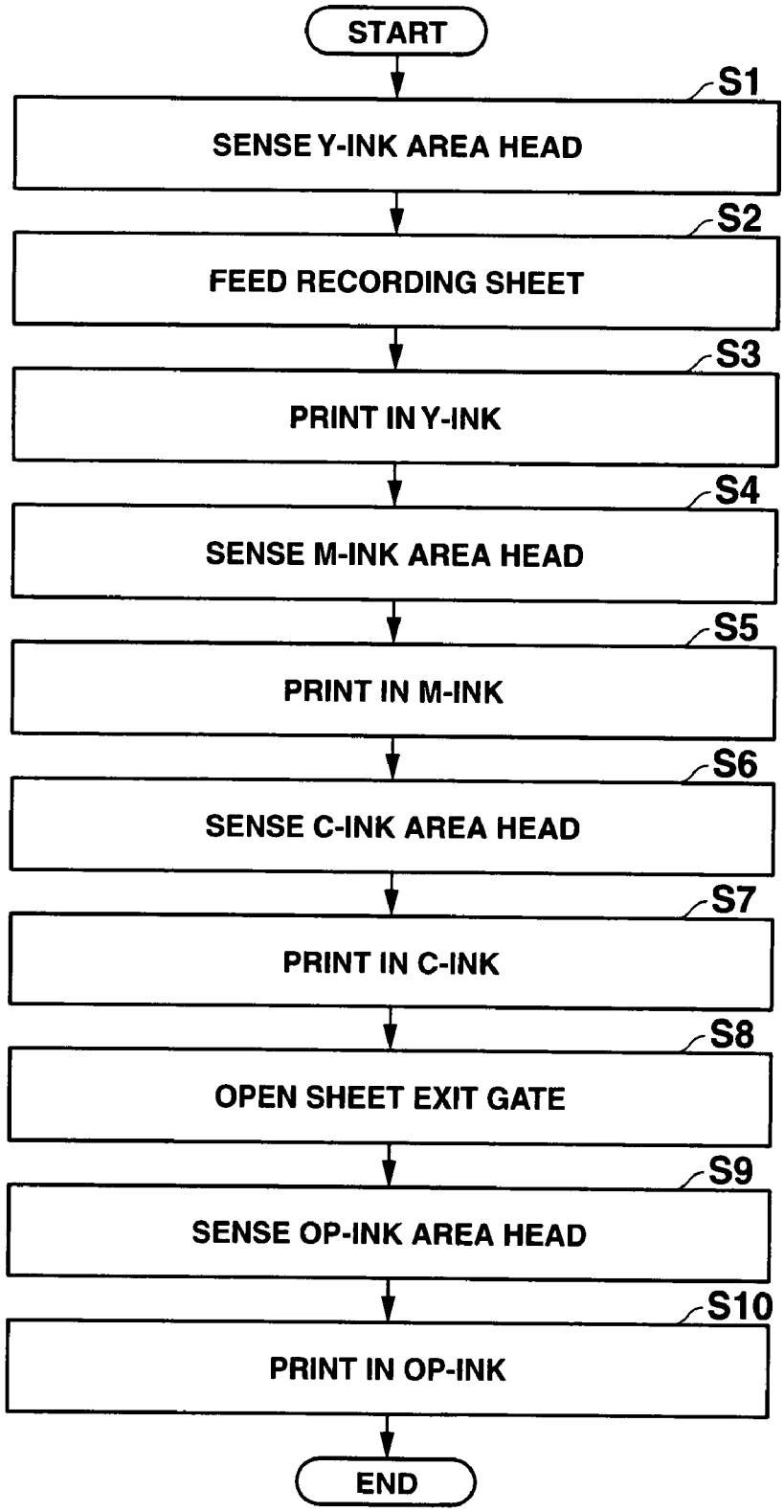
FIG. 5 is a flowchart of a printing process to be performed by the printer.

Next, operation of the printer will be described. FIG. 5 is a flowchart of a printing process to be performed by the printer. FIGS. 6A-6F illustrate a sequential operation of the printer. When the external device 100, which includes, for example, a personal computer which has stored data on a color photographic image, is given a command to print the image, the external device 100 produces yellow, magenta and cyan print data composing the color image, and transfers the data via I/F circuit 93 to the printer. Then, these data is stored in a print data area of the RAM 82 and the printing process shown in the FIG. 5 flowchart starts.

Figure 6A:
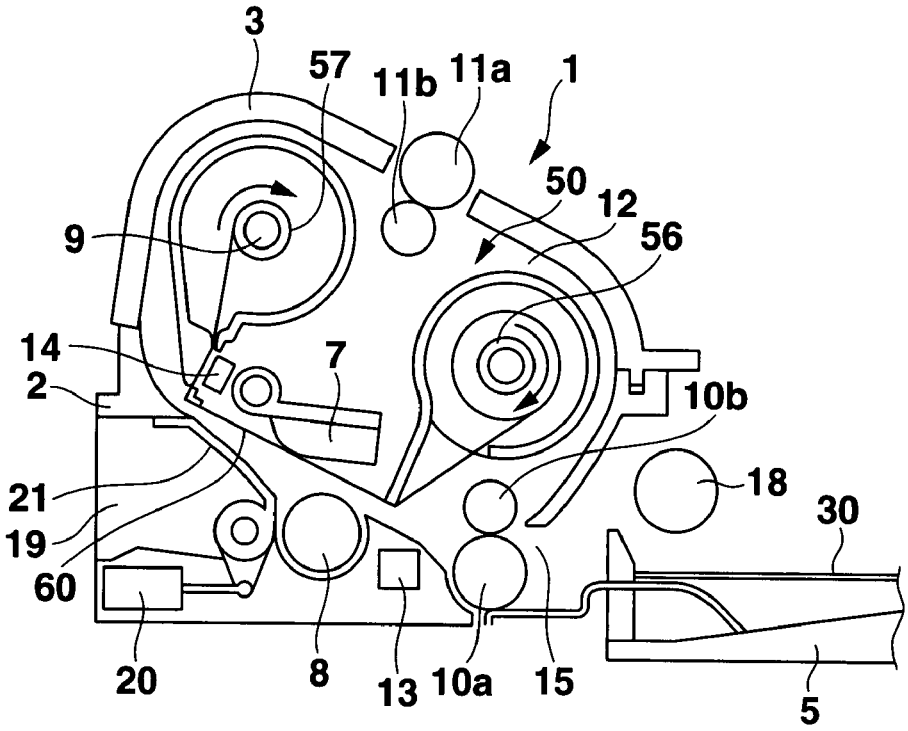
FIGS. 6A to 6F each illustrate an operational state of the printer.

First, a head of the yellow ink area 61 of the multi-color ink ribbon 60 is sensed (step S1), as shown in FIG. 6A. In this case, the ribbon take-up shaft 9 is driven by the DC motor 90 to feed out the ribbon in a state in which the thermal head 7 is separated from the platen roller 8. When the ribbon sensor 14 senses the head mark 65*a* of the yellow ink area 61, the DC motor 90 is stopped, thereby terminating this sensing operation.

Figure 6B:
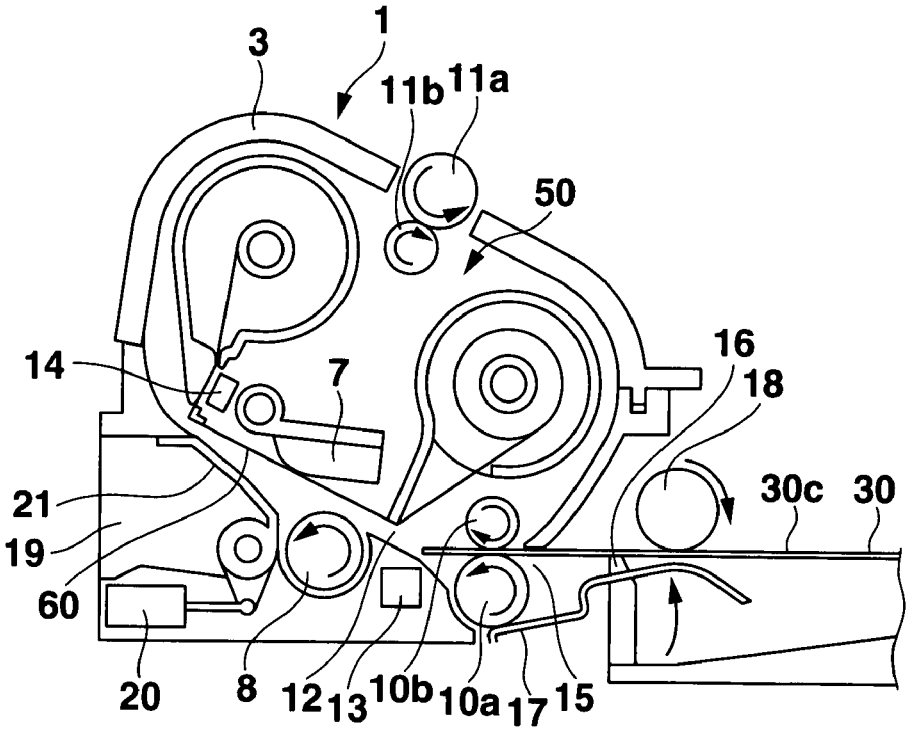

Then, a recording sheet 30 is fed from the tray 5 to the printer (step S2), as shown in FIG. 6B. Then, the DC motor 92 is driven forwardly, thereby rotating the pickup roller 18 in the sheet feed direction. Then, the sheet feed lever 17 moves so as to lift a top recording sheet 10, thereby bringing the sheet into contact with the pickup roller 18. Thus, the recording sheet 30 is separated by the separating pawl 16 and fed out into the printer with the recording surface of the sheet facing upward. When the sheet feeding is terminated, the DC motor 92 is driven backwardly and the sheet feed lever 17 is returned to its original position. A one-way clutch (not shown) is provided in the drive/transmission mechanism provided between the DC motor 92 and the pickup roller 18. Thus, the backward drive of the DC motor 92 is not transmitted to the pickup roller 18.

Figure 6C:
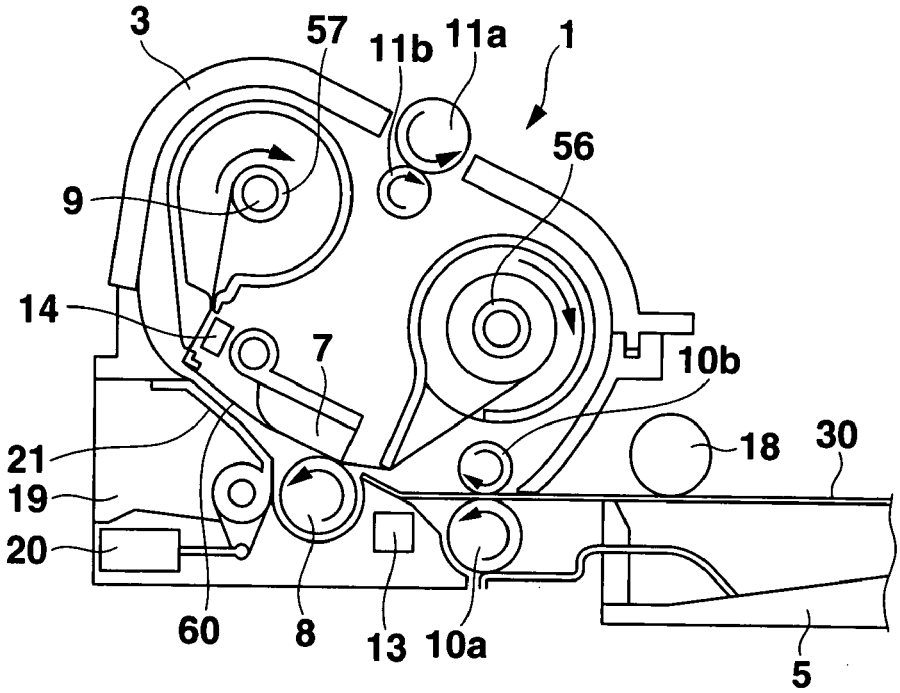
Figure 6D:
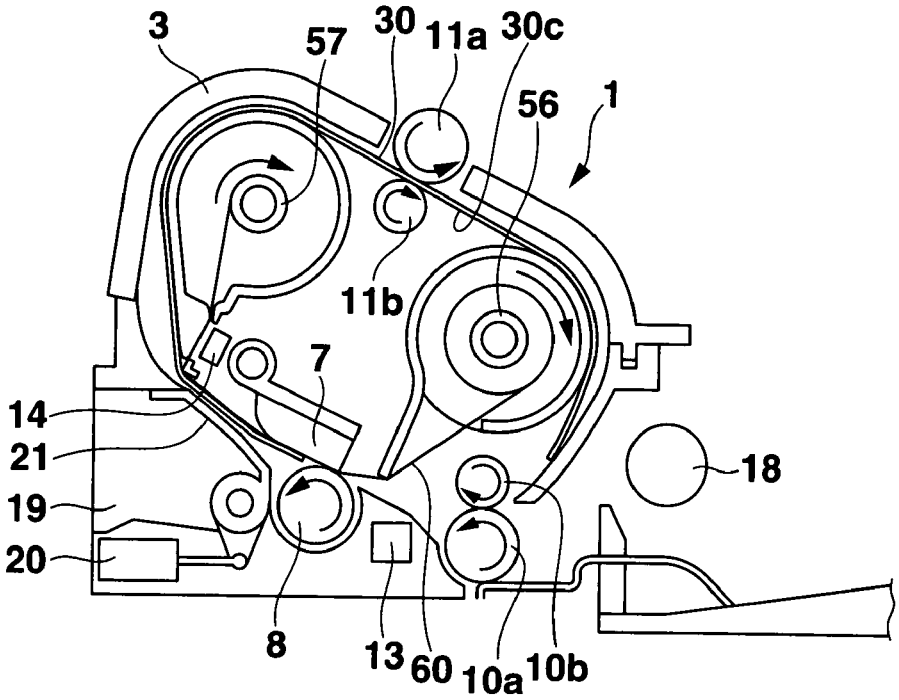

When the recording sheet 30 starts to be fed out, the step motor 86 is driven to rotate the platen roller 8 and the conveyance rollers 10*a* and 11*a*, thereby conveying the recording sheet 30 toward the thermal head 7 in the conveyance path 12. When the leading end of the recording sheet 30 arrives at the sheet sensor 13 provided upstream of the thermal head 7 and is sensed by the sheet sensor 13, the DC motor 88 is driven to move the thermal head 7 toward the platen roller 8 and feeds the recording sheet 30 at its leading end into between the thermal head 7 and the platen roller 8. Thus, the thermal head 7 moves to the printing position where the thermal head 7 presses against the platen roller 8, thereby starting the printing operation. In this case, the step motor 86 drives the platen roller 8, and the first and second conveyance rollers 10*a* and 11*a*. Accordingly, the recording sheet 30 is conveyed along the ring-like conveyance path 12 in one direction with the recording surface 30*a* of the sheet 30 facing the inside of the ring-like conveyance path 12. Then, the thermal head 7 is caused to generate heat so as to print yellow print data in a corresponding color ink. At this time, the DC motor 90 is driven to take-up a used part of the ink ribbon 60 loaded between the thermal head 7 and the recording sheet surface 30*a* into the ribbon cassette 50 (step S3). FIG. 6C illustrates sensing of the leading end of the recording sheet 30 by the sheet sensor 13 and a subsequent printing operation. FIG. 6D shows a state in which one color (for example, yellow) print data has been printed.

When the recording sheet 30 circulates once along the ring-like conveyance path 12, thereby terminating image printing in yellow, a head mark of the magenta area 62 of the ink ribbon 60 is sensed (step S4). Also in this case, the thermal head 7 is moved away from the platen roller 8 by the reverse rotation of the DC motor 88, which drives the ribbon take-up shaft 9 to feed the ribbon. When the ribbon sensor 14 senses a head mark 65*b* of the magenta ink area 62, the DC motor 90 is stopped, thereby terminating this process.

Figure 6E:
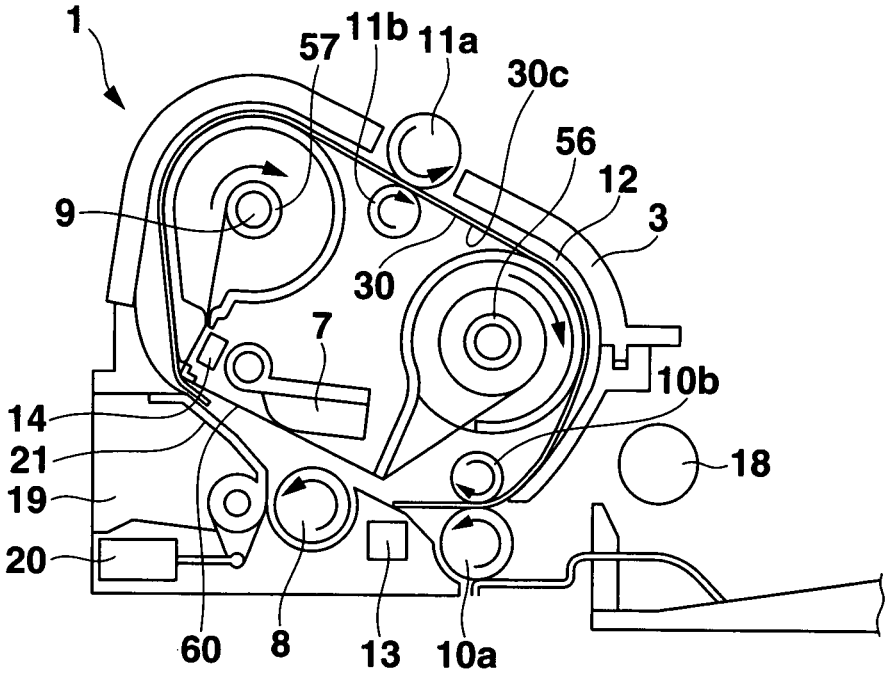

Then, when the sheet sensor 13 senses a leading end of the recording sheet 30, the DC motor 88 is driven to move the thermal head 7 toward the platen roller 8, thereby causing the sheet 30 to be fed at its leading end into between the thermal head 7 and the platen roller 8. Thus, the thermal head 7 moves to the printing position where the thermal head 7 presses against the platen roller 8, thereby starting the printing operation. The recording sheet 30 is conveyed along the ring-like conveyance path 12 in one direction by driving the platen roller 8, and the first and second conveyance rollers 10*a* and 11*a*, and the thermal head 7 is driven to print the print data as an image in the magenta ink in the superimposed manner on the yellow image previously printed on the recording sheet surface 30*a* (step 5). FIG. 6E illustrates sensing a head mark of the magenta ink area and sensing a leading end of the recording sheet 30.

When the data is printed in magenta, a head mark of the cyan ink area 63 is sensed as in step S4 (step S6), and the thermal head 7 is driven to print data in cyan on the recording sheet surface 30*a* (step S7).

Figure 6F:
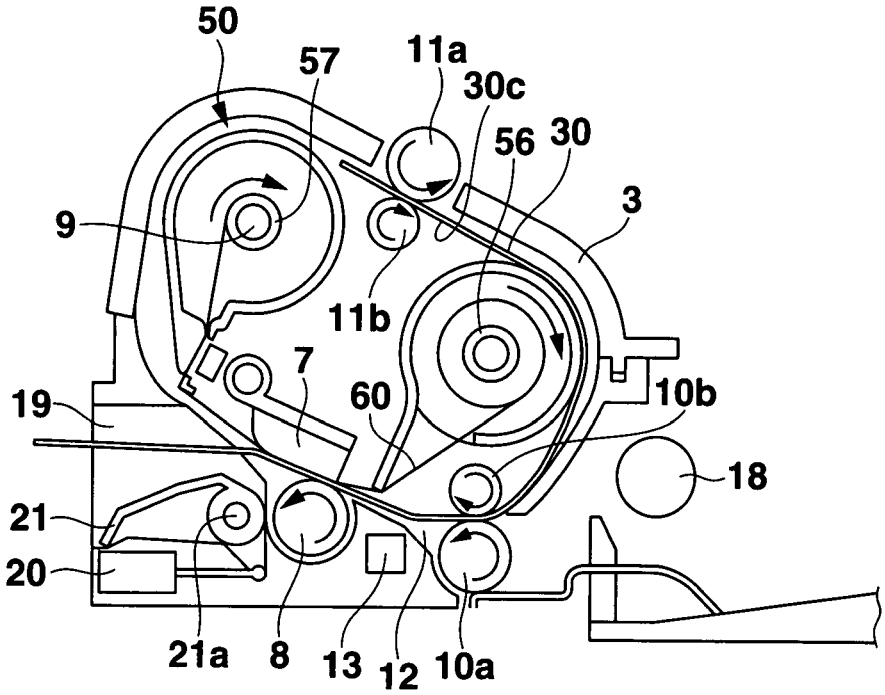

When the cyan printing ends, the solenoid 20 is driven, thereby opening the sheet exit gate 21 (step S8). Then, a head mark of the overcoat ink area 64 is sensed (step S9), and the thermal head 7 is driven, thereby transferring an ink of the overcoat ink area 64 to the whole sheet recording face 30*a* in a superimposed manner. Then, a resulting recording sheet 30 is moved away from the conveyance path 12 by the platen roller 8, and the first and second conveyance rollers 10*a* and 11*a* and discharged from the sheet exit 19 to the outside (step 10). FIG. 6F illustrates transfer of the ink of the overcoat ink area 64.

According to the printer of this embodiment, the thermal head 7, the ribbon cassette 5 and the ribbon take-up shaft 9, and the thermal head moving mechanism are disposed within the inside of the ring-like conveyance path 12. Thus, the inside of the conveyance path 12 is used effectively and the printer is reduced in size.

The conveyance path 12 through which the recording sheet 30 is conveyed in the circulating manner includes the gap between the printer housing 3 and the ribbon cassette 50 loaded in the ribbon cassette receiving space 6 within the printer housing. That is, the conveyance path 12 can be easily formed simply by disposing the ribbon cassette 50 in the ribbon cassette receiving space 6 within the printer housing. Thus, the printer structure is simplified.

The recording sheet 30 is conveyed with its recording face 30*c* facing the inside of the ring-like conveyance path 12 and with the back of the recording sheet facing the outside of the ring-like conveyance path 12. Thus, the recording sheet 30 which circulates along the ring-like conveyance path 12 with the recording face 30*c* bent along the path 12 so as to face its inside tends to unbend outward from the conveyance path 12 because of its resiliency. Therefore, the recording face 30*c* facing the inside of the ring-like conveyance path 12 is difficult to come into contact with the inner wall of the conveyance path 12, which prevents scratches or the like from being possibly produced otherwise. The recording sheet 30 is conveyed while being held between the drive rollers 10*a*, 11*a* and the follower rollers 10*b*, 11*b* provided on the sides of the back and recording faces, respectively, and the conveyance drive force is applied to the back of the recording sheet 30. Thus, the recording face 30*c* is protected from scratches or the likes which may otherwise be subjected to.

Figure 7A:
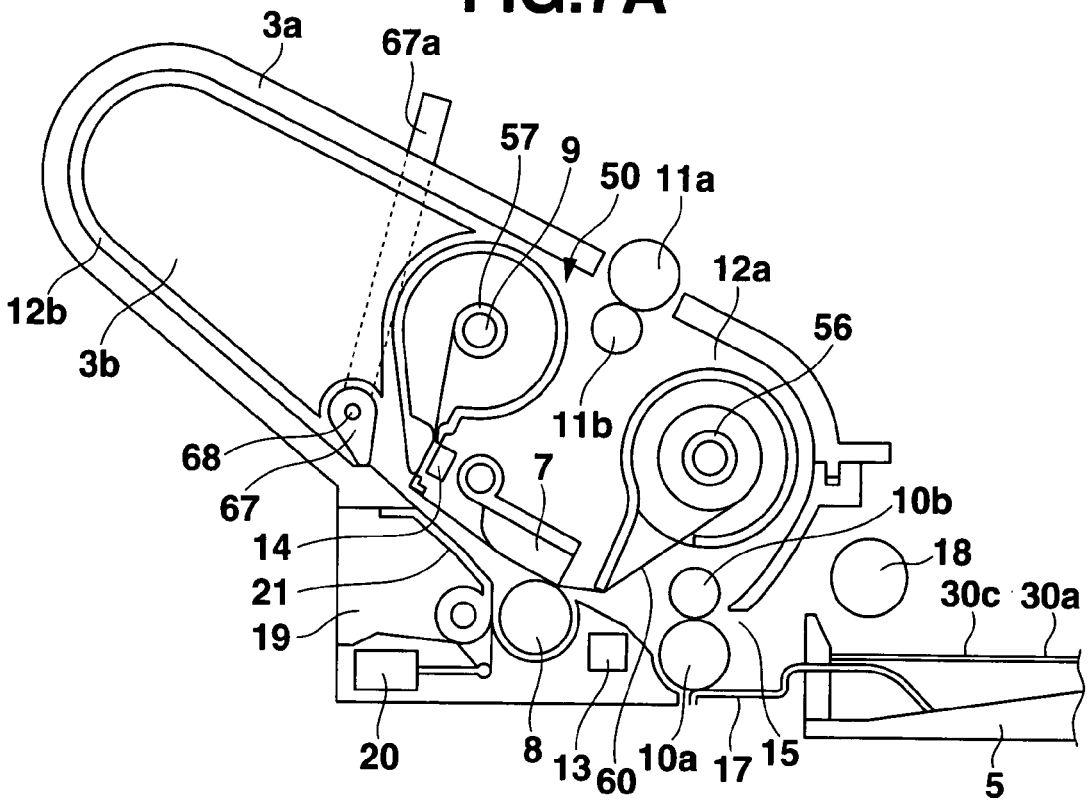
FIGS. 7A to 7C each show, in a different operational state, a cross section view of a printer of a second embodiment according to the present invention.
Figure 7B:
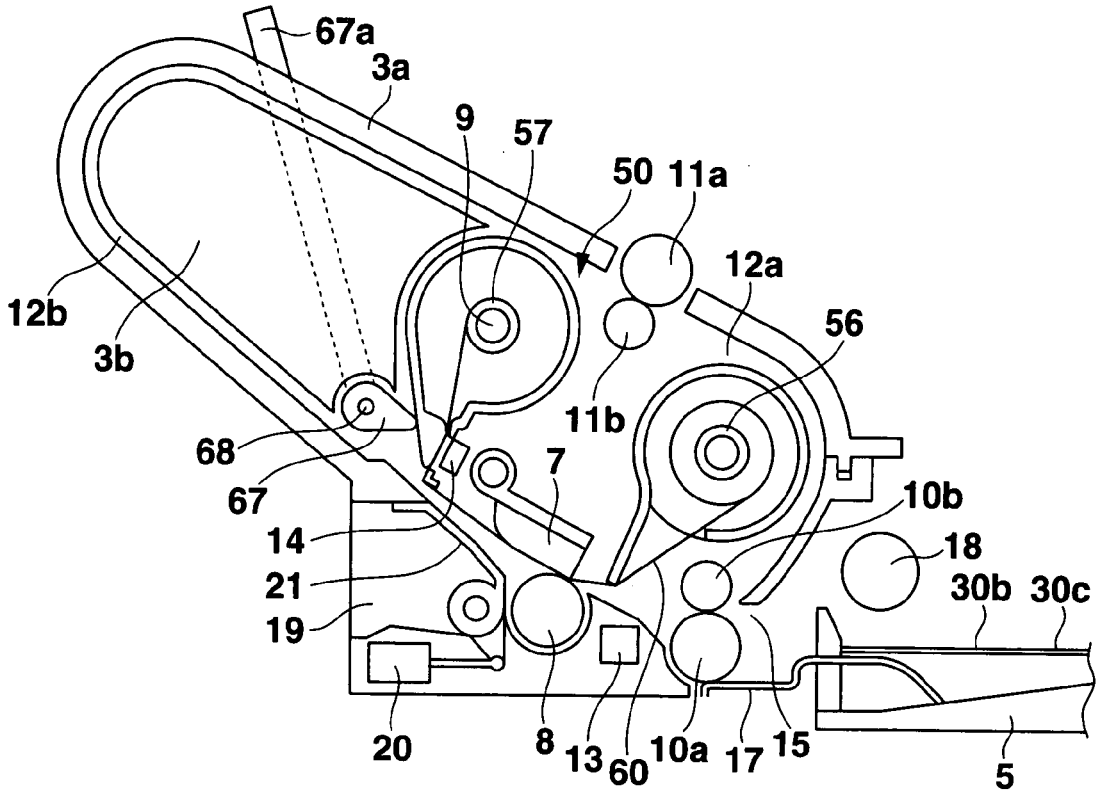

FIGS. 7A and 7B each are a schematic cross section view of a printer of a second embodiment. This printer has the same structure as that of the first embodiment excluding that the former includes two conveyance path parts different in length.

More particularly, the printer of FIGS. 7A and 7B has a first circulating conveyance path part 12A for use in printing, for example, on a postal card- or L-sized (89 mm×127 mm) photographic paper sheet (hereinafter referred to as a first recording sheet 30*a*) and a second circulating conveyance path part 12*b* for use in printing, for example, on a 2 L-sized (127 mm×178 mm) photographic paper sheet (hereinafter referred to as a second recording sheet 30*b*). The second conveyance path part 12*b* is formed between a U-like cross-sectional housing part 3*a* and a path forming member 3*b* disposed within the U-like housing part 3*a* and having a cross section whose configuration is substantially complementary to the inner surface of the U-like cross-sectional housing part 3*a*. The first conveyance path part 12*a* is the same as the conveyance path 12 of the first embodiment and somewhat larger than 127 mm which is the length of a longer side of the first recording sheet 30*a* in the conveyance direction. The second conveyance path part 12*b* is somewhat longer than 178 mm which is the length of a longer side of the second recording sheet 30*b* in the conveyance direction.

Figure 7C:
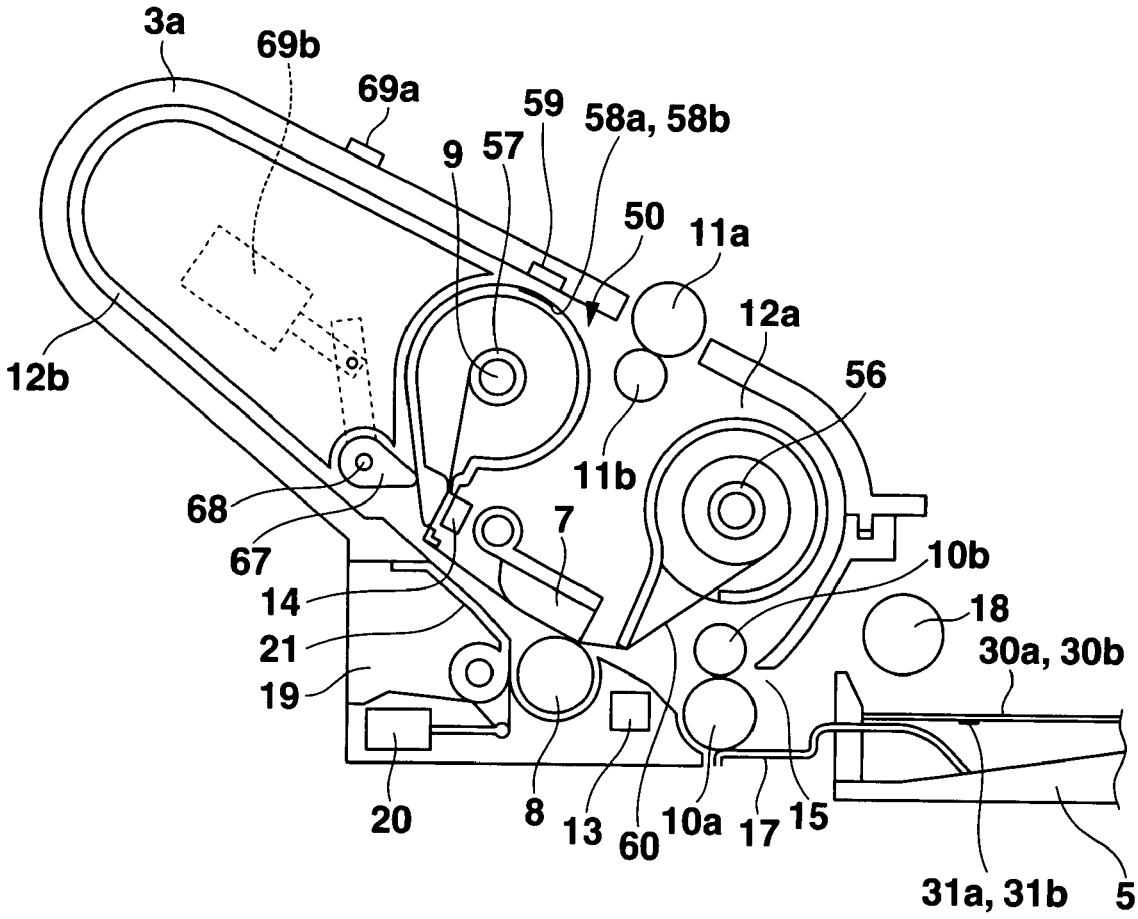

The second conveyance path part 12*b* has a common part with the first conveyance path 12*a*. A switching member 67 is provided at one end of the common part to the first and second conveyance paths 12*a* and 12*b*. The switching member 67 has a shaft 68 which is rotatably supported by the cover 3 and fixed to a manual lever 67*a* provided outside the printer housing such that when the lever is manually turned clockwise or counterclockwise, the switching member 67 is turned in that direction around the shaft 68, thereby selecting the first conveyance path part 12*a* or the second conveyance path part 12*b*. FIGS. 7A and 7B show selection of the first and second conveyance path parts 12*a* and 12*b*, respectively. Thus, the user selects a conveyance path part depending on the kind of first recording sheets 30*a* or second recording sheets 30*b* set on the tray 1. As shown in FIG. 7C, alternatively, an operation switch 69*a* may be disposed on the outer surface of the printer so as to control operation of the switching member 67, using a drive source such as a solenoid 69*b*.

Alternatively, information including a mark 31*a* or 31*b* indicative of the type of each of the first and second recording sheets 30*a* and 30*b* may be printed beforehand to the back of that sheet such that when that sheet is fed, the sheet sensor 13 senses the information and the controller 80 determines based on the information whether the sheet is the first or second recording sheet and then drives the solenoid 94 and hence the switching member 67, if necessary.

Figure 8:
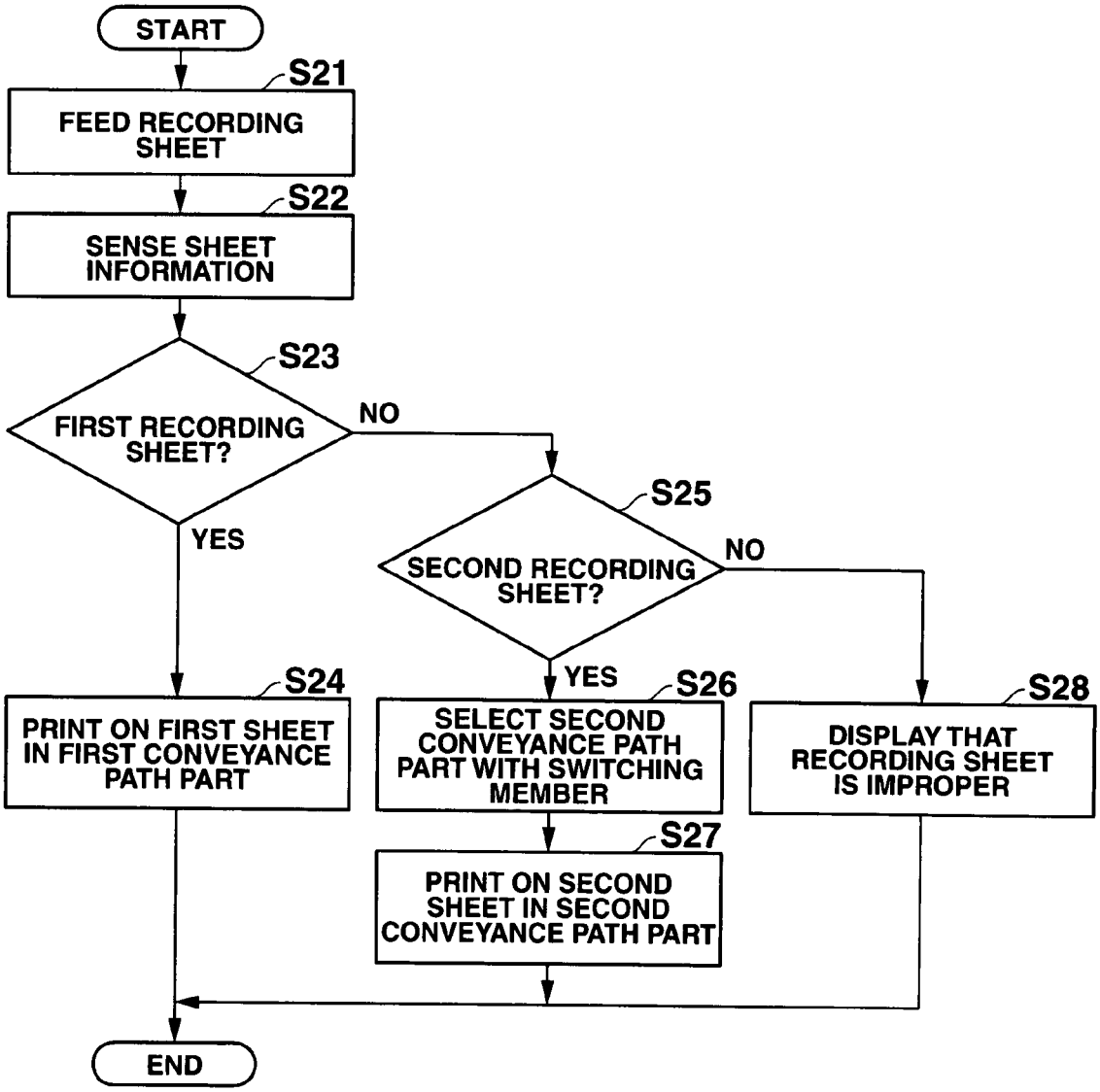
FIG. 8 is a flowchart of a printing process to be performed by the printer of the second embodiment.

FIG. 8 illustrates a flowchart of a printing process to be performed by the printer of the second embodiment. This printer has an electronic circuit similar to that shown in FIG. 4. The solenoid 69*b* is arranged to be controlled by the controller 80 so as to actuate the switching member 67. At the start of printing, the switching member 67 is switched so as to select the first conveyance path 12*a*, as shown in FIG. 7A. In FIG. 8, at the start of printing, one of recording sheets piled on the tray 5 is fed through the sheet inlet 15 into the printer housing 1 (step S21). At this time, the sheet sensor 13 senses the sheet type information printed on the sheet. Then, the controller 80 reads this information (step S22) and determines based on the information whether the recording sheet is the first recording sheet 30*a* (step S23). If so (YES in step S23), printing is performed on the first recording sheet 30*a* using the first conveyance path part 12*a* (step S24) in accordance with the processing steps shown in FIG. 5. When the recording sheet is not the first one 30*a* (NO in step S23), then the controller 80 determines whether the sheet is the second recording one 30*b* (step S25). If so, the controller 80 drives the solenoid 69*b* to actuate the switching member 67, thereby selecting the second conveyance path part 12*b* (step S26) and then performs the printing process on the second recording sheet 30*b* using the second conveyance path part 12*b* (step S27). This printing also is performed in accordance with the steps of FIG. 5. When the controller 80 determines in step S25 that the recording sheet is not the second one 30*b*, it displays an error message on the display 95 that the recording sheet is not appropriate (step S28), thereby terminating the process.

The length of each of the ink areas of the multi-color ink ribbon is required to exceed at least the length of the recording sheet. In the second embodiment, any of the two kinds of sizes of recording sheets (first and second recording sheets 30*a* and 30*b*) can be selected for printing. Thus, if a ribbon cassette which contains a multi-color ink ribbon of different ink areas corresponding in length to the second larger recording sheet 30*b* is prepared, printing is also possible on the first recording sheet 30*a* with the ribbon cassette. However, if the same ribbon cassette that contains a multi-color ink ribbon is used both for the first and second recording sheets 30*a* and 30*b*, a part of the ink ribbon would be wasted when the first recording sheet 30*a* is printed. Thus, two kinds of (first and second) ribbon cassettes suitable for the first and second recording sheets 30*a* and 30*b*, respectively, are preferably prepared.

In this case, a ribbon cassette appropriate for recording sheets to be used is required to be selected. To this end, the two kinds of ribbon cassettes may beforehand have cassette different information 58*a* and 58*b*, indicative of the kind of multi-ribbons contained in those cassettes, printed on their respective outer surfaces such that when any one of the ribbon cassettes is set at the predetermined position within the housing 1, the cassette information is sensed by a sensor such as an optical sensor 59 provided within the housing 1. Then, the controller 80 determines based on the sensed cassette information whether a combination of the recording sheet and the ribbon cassette is proper, thereby performing a required process.

Figure 9:
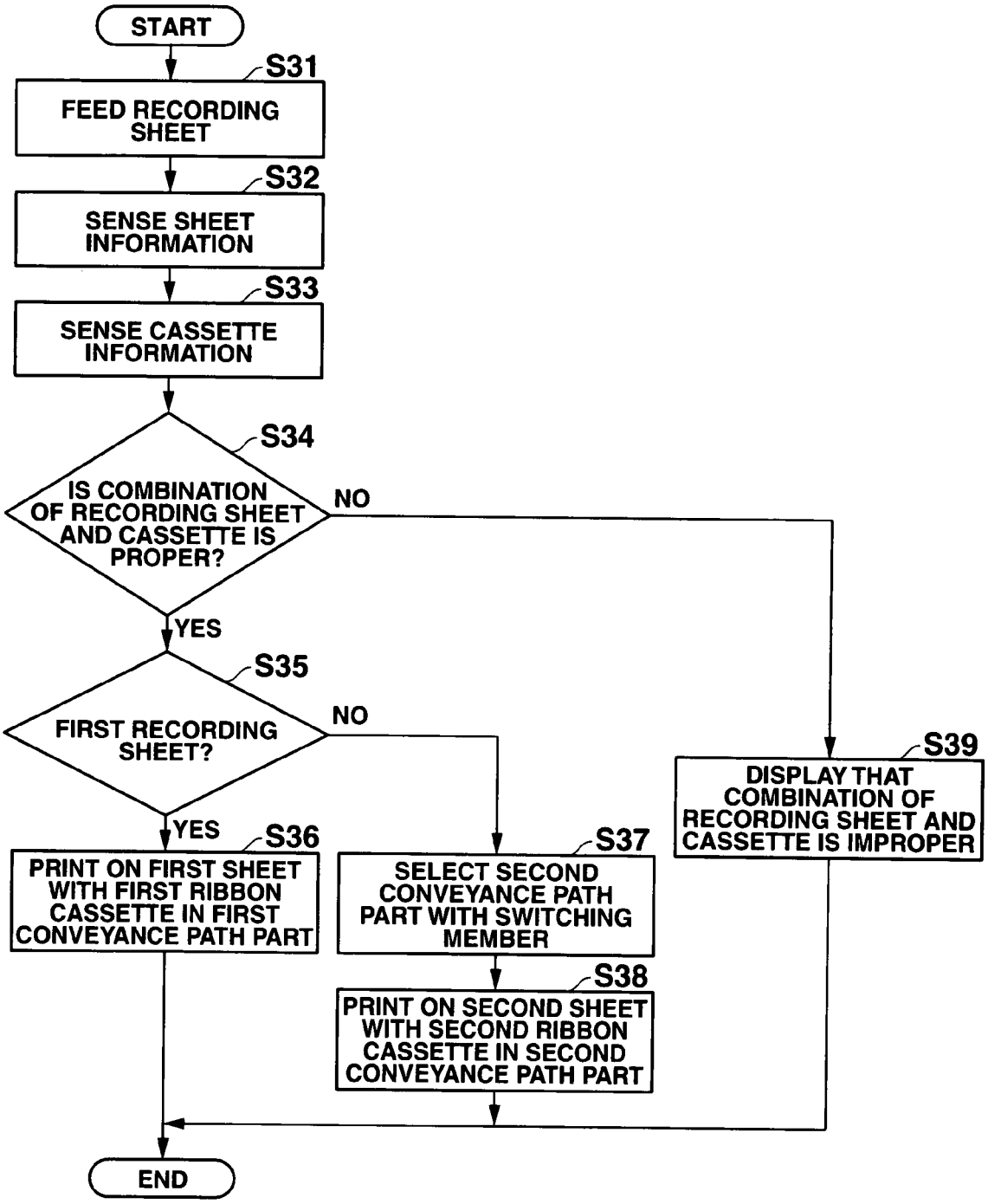
FIG. 9 illustrates a flowchart of another printing process to be performed by the printer of the second embodiment.

FIG. 9 illustrates a flowchart of a second printing process to be performed by the printer of the second embodiment when the first and second recording sheets 30*a* and 30*b* as an object of printing and the first and second ribbon cassettes suitable for the first and second recording sheets 30*a* and 30*b*, respectively, are prepared. This printer has a same electronic circuit as shown in FIG. 4. Further, it has a cassette sensor. In the printer, the cassette sensor senses cassette information put on the first or second ribbon cassette set within the cover 3. The operation of the solenoid that actuates the switching member 67 is controlled by the controller 80. In the start of printing, the switching member 67 is at a position shown in FIG. 7A.

In FIG. 9, in the start of printing, a recording sheet set on the tray 5 is fed through the sheet inlet 15 into the printer (step S31). Then, the sheet information attached to the recording sheet is sensed by the sheet sensor 13 (step S32) and the cassette information is sensed by the cassette sensor (step S33). Then, the controller 80 determines based on these information whether a combination of the recording sheet and the cassette is proper (step S34). If so (YES in step S34), the controller 80 then determines whether the recording sheet is the first recording sheet 30*a* (step S35). If so (YES in step S35), the first recording sheet 30*a* is conveyed in a circulating manner while being printed, using the first ribbon cassette compatible with the first recording sheet 30*a* and set within the housing 1 (step S36). This printing is performed in accordance with the order of the processing steps shown in FIG. 5. When the recording sheet is determined not to be the first one 30*a* (NO in step 35), the solenoid 69*b* is driven to actuate the switching member 67, thereby selecting the second conveyance path part 12*b*, because the second recording sheets 30*b* are set on the tray 5 (step S37). Then, the second recording sheet 30*b* is conveyed in the circulating manner along the second conveyance path part 12*b* while being printed, using the second ribbon cassette compatible with the second recording sheet 30*b* and set within the housing 1 (step S38). This printing process is also performed in accordance with the order of the processing steps shown in FIG. 5. When the controller 80 determines in step S34 that the combination of the recording sheet and the cassette is not proper, an error message indicating this fact is displayed on the display 95 (step S39), thereby terminating the processing.

Figure 10:
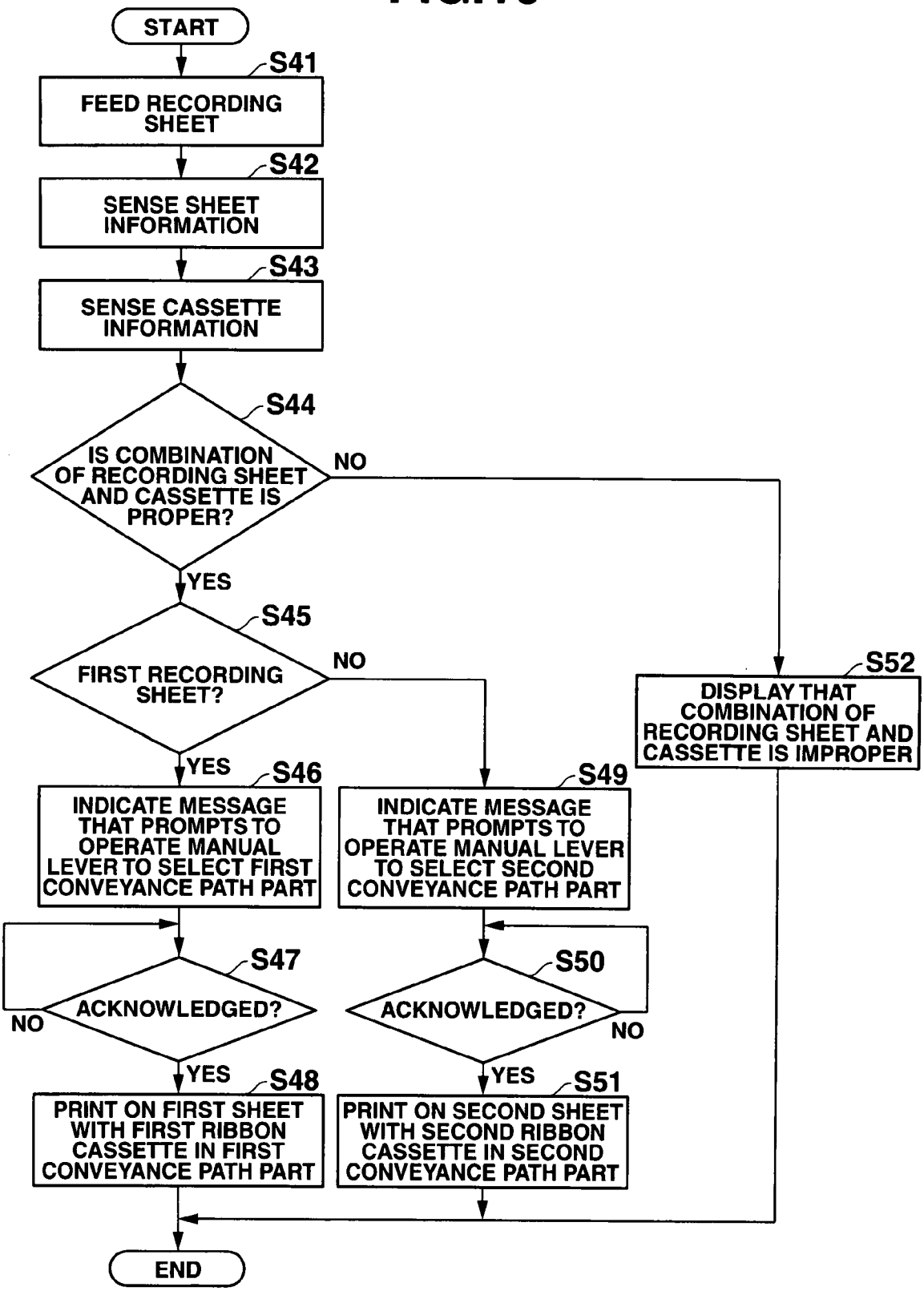
FIG. 10 illustrates a flowchart of still another printing process to be performed by the printer of the second embodiment.

FIG. 10 shows a further flowchart of still a further printing process to be performed by the printer of the second embodiment when the user actuates the switching member 67 by operating the switch lever (not shown). The printer should include an acknowledge key that is operated to input an acknowledge signal, as required.

In FIG. 10, at the start of printing, a recording sheet set on the tray 5 is fed into the printer through the sheet inlet 15 (step S41). Then, the sheet information indicative of the first or second recording sheet is sensed by the sheet sensor 13 (step S42) and the cassette information indicative of the kind of the cassette is sensed by the cassette sensor (step S43). It is then determined by the controller 80 based on the sensed sheet information and cassette information whether a combination of the record sheet and the cassette is proper (step S44). If so (YES in step S44), it is then determined whether the sheet information indicates the first recording sheet 30*a* (step S45). If so (YES in step S45), a message is displayed on the display 95, indicating that the manual switch lever should be operated to select the first conveyance path part 12*a* (step S46). Then, the user operates the switch member in accordance with the message and operates the acknowledge key provided on the printer to input an acknowledge signal. When this signal is inputted (YES in step S47), the first recording sheet 30*a* is conveyed in a circulating manner along the first conveyance path part 12*a* while being printed, using the first ribbon cassette corresponding to the first recording sheet 30*a* set within the housing 1 (step S48). This printing process also is performed in accordance with the order of the processing steps shown in FIG. 5. When it is determined based on the sensed sheet information that the recording sheet is not the first one 30*a* (NO in step S45), a message is displayed on the display 95, indicating that the switch lever should be operated to select the second conveyance path part 12*b* (step S49) because the second sheet is set within the housing 1. The user operates the switch lever in accordance with the message and then operates the acknowledge key to input an acknowledge signal. When this signal is inputted (YES in step S50), the second recording sheet 30*b* is conveyed in a circulating manner along the second conveyance path part 12*b* while being printed, using the second ribbon cassette corresponding to the second recording sheet 30*b* set within the cover 3 (step S51). This printing process is also performed in accordance with the order of the processing steps shown in FIG. 5. When it is determined in step S44 that the combination of the recording sheet and the cassette is not proper, an error message is displayed on the display 95, indicating that fact (step S52), thereby terminating the process.

The printer of the second embodiment has first and second conveyance path parts 12*a* and 12*b* corresponding in length to the first and, second recording sheets 30*a* and 30*b*, respectively, in the conveyance direction such that an appropriate one of the two conveyance path parts may be selected depending on the length of a recording sheet, to be printed, in the conveyance direction. Thus, according to the printer, an undesirable situation is avoided such as wastes time to convey a recording sheet in the circulating manner, thereby requiring a long printing time or overlaps recording sheets, thereby making satisfactory printing impossible, when the recording sheet is short compared to the conveyance path. In addition, the printer of the second embodiment is basically the same in structure as that of the first embodiment in that the thermal head and ribbon cassette are provided within the inside of the ring-like conveyance path. Thus, the printer is reduced in size and produces advantages similar to those produced by the printer of the first embodiment.

Figure 11:
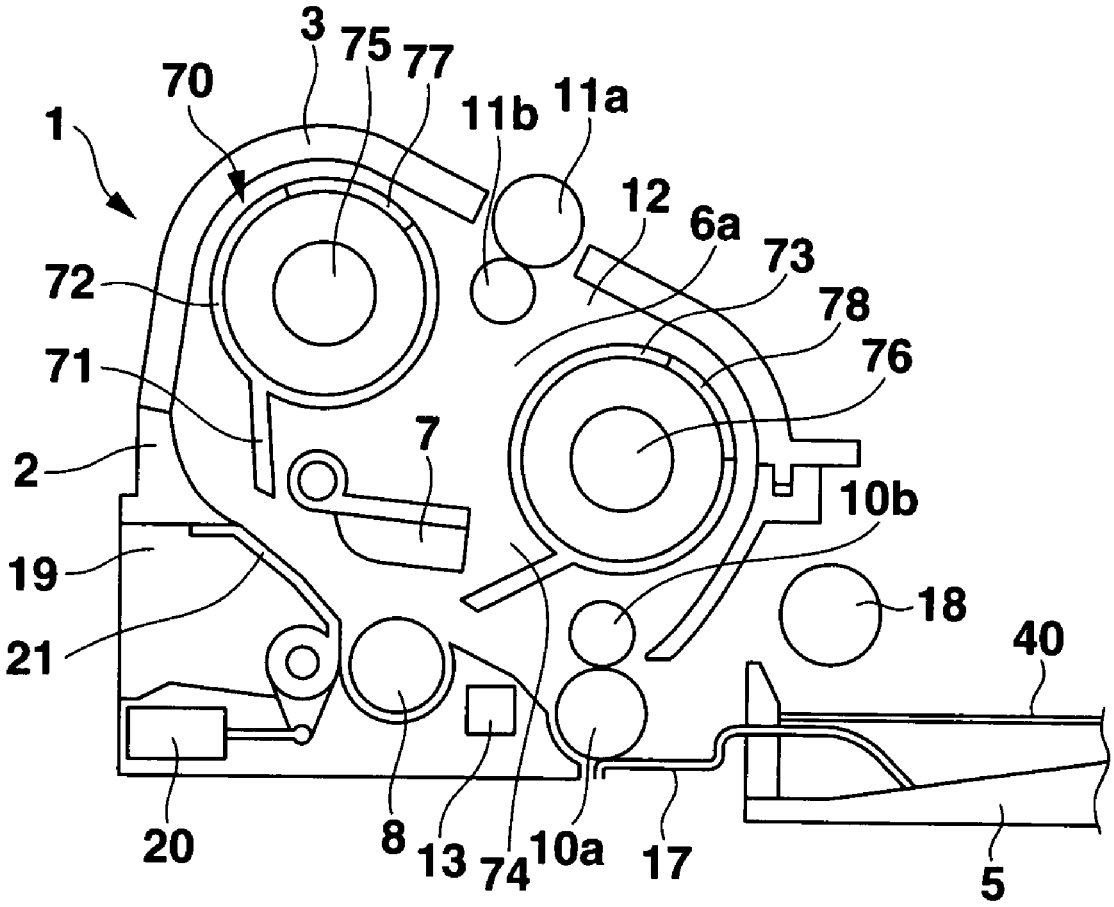
FIG. 11 is a schematic cross section view of a printer of a third embodiment according to the present invention
Figure 12:
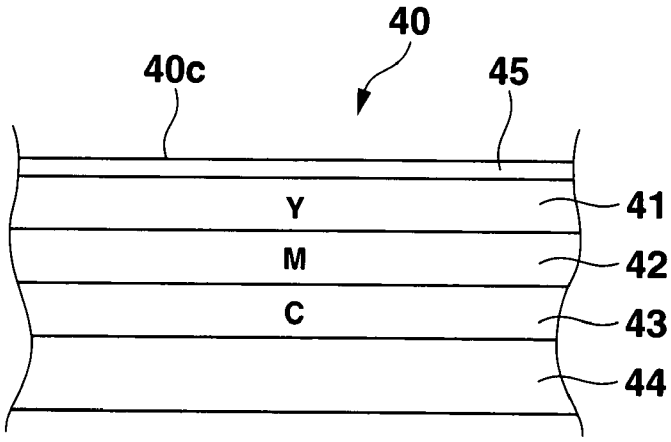
FIG. 12 illustrates the structure of a recording sheet to be used in the printer of the third embodiment.
Figure 13:
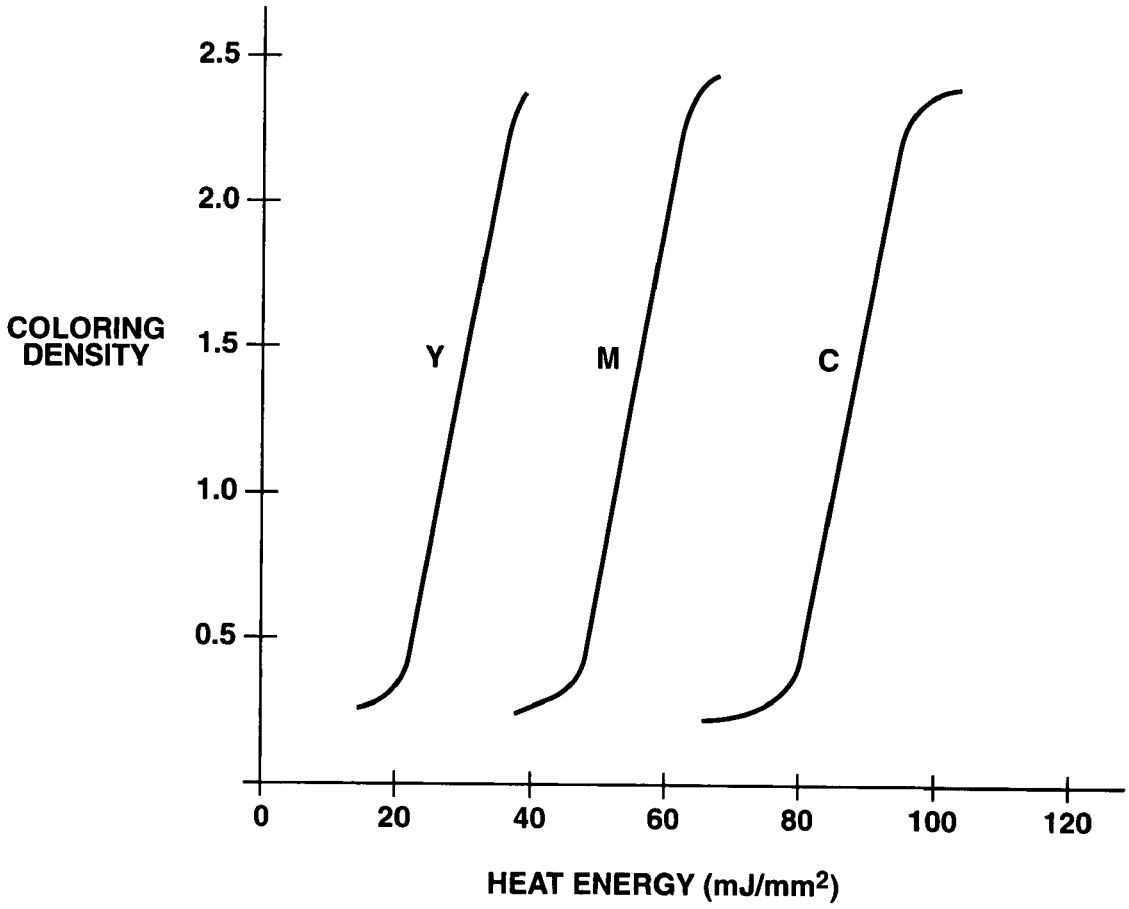
FIG. 13 illustrates a coloring density of each of coloring layers of the recording sheet and heat energy applied to the coloring layer.

A printer of a third embodiment will be described next. FIG. 11 shows a schematic cross section view of this printer. FIG. 12 illustrates a recording sheet to be used in this printer. FIG. 13 illustrates a relationship between a coloring density of each of different coloring layers of the recording sheet and heat energy required to produce the coloring density. While the printer of the first embodiment sequentially transfers the respective different color inks of the multi-color ink ribbon thermally to the recording sheet in the superimposed manner, the printer of the third embodiment uses a heat- and light-sensitive recording sheet having yellow, magenta and cyan coloring layers provided superimposed on the recording sheets and causes the respective layers to be colored with heat generated by a thermal head, thereby printing a full color image.

As shown in FIG. 12, the recording sheet 40 to be used in the printer of the third embodiment is disclosed, for example, in Unexamined Japanese Patent Application KOKAI Publication No. 11-91170. A recording face 40*a* of the sheet has a heat-sensitive laminate of yellow, magenta and cyan layers 41, 42 and 43 of the same thickness provided on a sheet-like support 44 with the yellow layer 41 covered with a heat-resistant protective layer 45 where an upper surface of the protective layer 45 is the recording face 40*a*. Each of the yellow (Y), magenta (M) and cyan (C) heat-sensitive coloring layers 41-43 includes main coloring materials contained in respective small heat-sensitive capsules dispersed along with other components in a combining material. In order to control the coloring of the three Y, M and C layers with heat energy, their heat sensitivities are designed so as to decrease (or their coloring temperatures increase) in this order, as shown in FIG. 13. Thus, yellow, magenta and cyan images can be recorded with different heat energies. After coloring, each of the yellow and magenta layers is irradiated with light of a respective predetermined wavelength such that the colored state of the layer is fixed so as to be colored no longer with next higher coloring heat energy.

The printer of FIG. 11 prints a full color image on the recording sheet 40 of FIG. 12. This printer is the same as that of the first embodiment in that the thermal head 7 records an image thermally, but different from the printer of the first embodiment in that the former comprises an optical fixing unit 70 which fixes a colored layer optically. As shown in FIG. 11, the printer comprises the optical fixing unit 70 encased in a reception space 6*a* within the housing 1 thereof. The optical fixing unit 70 in turn comprises Y and M fixing light source housings 72 and 73 connected by a connection member (not shown), with the thermal head 7 disposed in a space 74 between those housings. The housings 72 and 73 have encased lamps 75 and 76 which fix colored yellow and magenta layers 41 and 42, respectively, provided on the recording sheet 40. The housings 72 and 73 have windows 77 and 78, respectively, through which light from the lamps 75 and 76 are arranged to be irradiated onto predetermined areas of the ring-like conveyance path formed between the housing 1 and the optical fixing unit 70.

Also, in the printer of this third embodiment as in the first embodiment, the thermal head 7 and the optical fixing unit 70 are provided within the inside of the ring-like conveyance path 12 within the housing 1.

Figure 14:
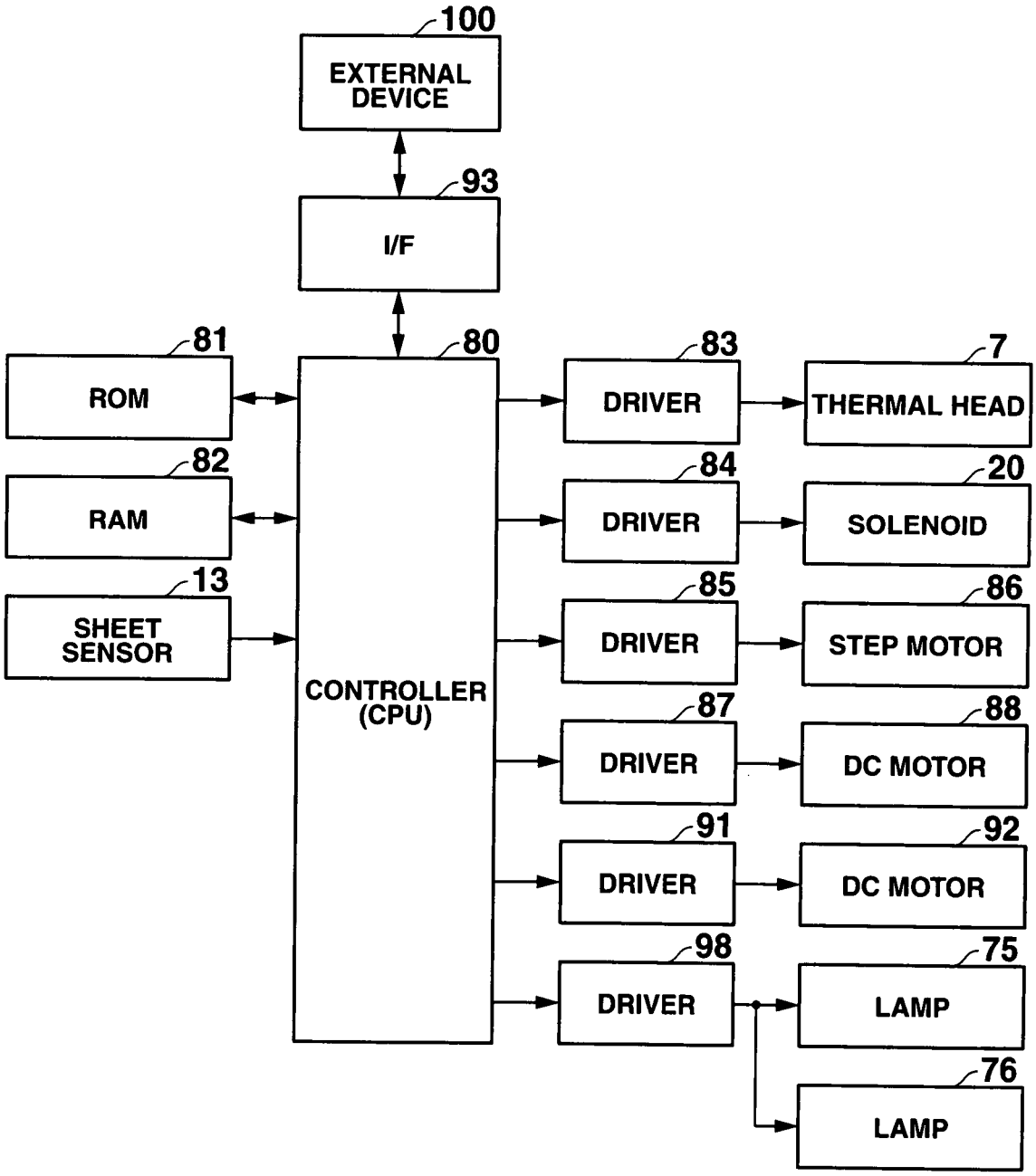
FIG. 14 is a block diagram of an electronic circuit of the printer of the third embodiment.

FIG. 14 is a block diagram of an electronic circuit of the printer of the third embodiment. As shown, a controller 80 lights up the lamps 75 and 76 of the optical fixing unit 70 through a driver 98 at predetermined times. The same reference numeral in FIGS. 14 and 4 denote the same part.

Figure 15:
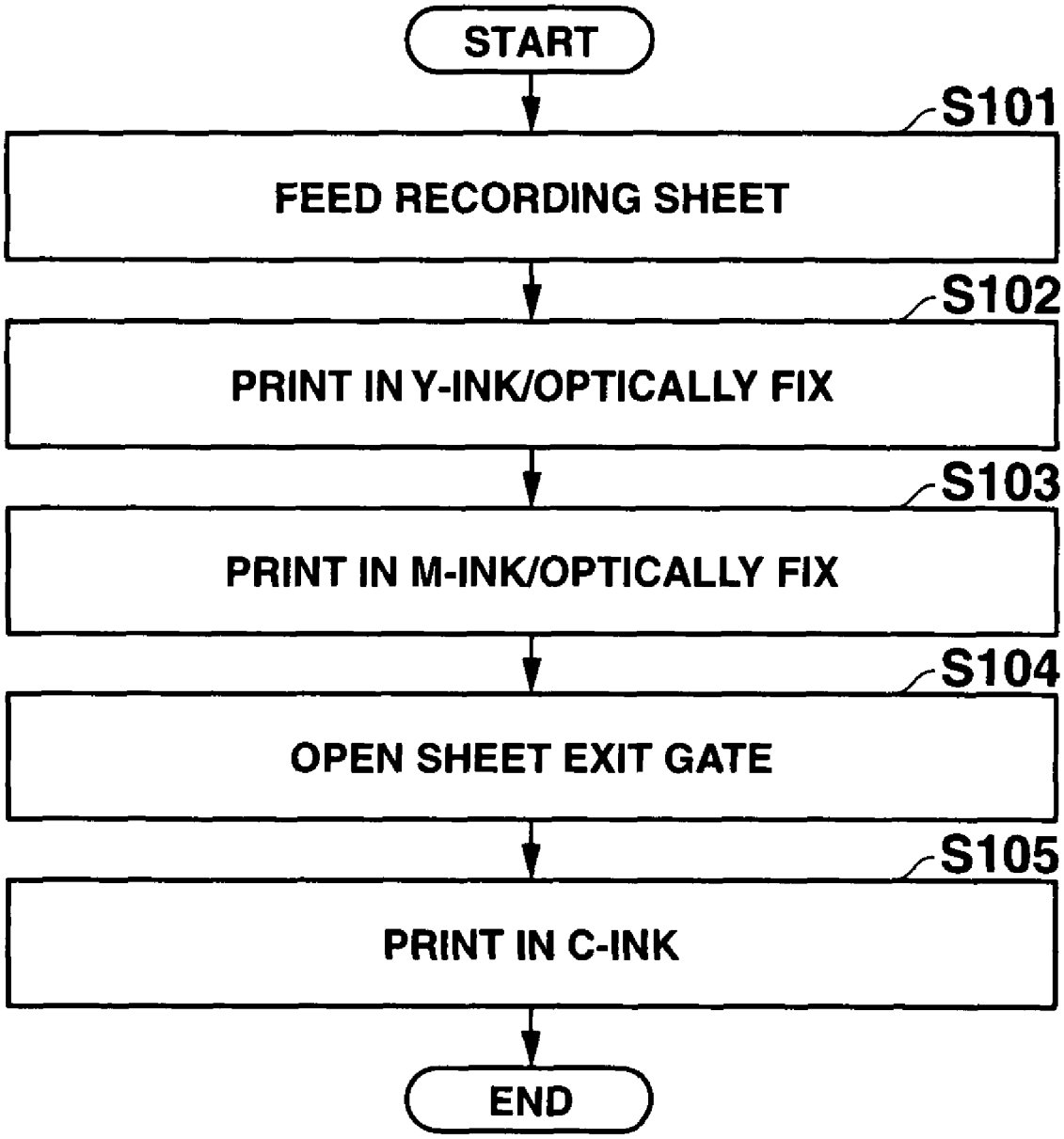
FIG. 15 is a flowchart of a printing process to be performed by the printer of the third embodiment.

FIG. 15 is a flowchart of a printing process to be performed by the printer of the third embodiment. When a command to print a photographic image whose data is stored in an external device 100 is given to the same, the external device 100 produces yellow, magenta and cyan print data on the photographic image and transfers these data to the printer via an I/F circuit 93. The data received from the external device 100 is stored in a print data area of a RAM 82 and then a printing process shown in the flowchart of FIG. 14 is performed.

First, a top recording sheet 40 is fed from the tray 5 to the printer (step S101). The DC motor 92 is driven forwardly, thereby rotating the pickup roller 18 in the sheet feed direction. The sheet feed lever 17 moves so as to lift the recording sheet 40, thereby bringing the recording sheet 30 into contact with the pickup roller 18. This causes the recording sheet 40 to be separated from the remaining ones and then is fed to the printer. After this, the DC motor 92 is driven backwardly, thereby returning the sheet lever 17 to its original position. A one-way clutch (not shown) is provided in the drive/transmission mechanism between the DC motor 92 and the pickup roller 18 such that when the DC motor 92 is driven backwardly, driving power is not transmitted to the pickup roller 18.

Then, the step motor 86 is driven to rotate the platen roller 8 and the drive rollers 10*a* and 11*a*, thereby conveying the recording sheet 40 toward the thermal head 7 provided at the conveyance path 12. When the leading end of the recording sheet 40 is sensed by the sheet sensor 13, the DC motor 88 is driven, and the thermal head 7 moves to the printing position where the thermal head 7 presses against the platen roller 8, thereby starting the printing operation. In this printing, the platen roller 8, and the first and second conveyance rollers 10*a* and 11*a* are driven by the step motor 86, thereby conveying the recording sheet 40 along the conveyance path 12 in the predetermined direction with the recording sheet face 40*a* facing the inside of the conveyance path 12. Then, the thermal head 7 is driven to apply heat to and color the yellow layer 41 on the recording sheet 40 with the yellow print data. The lamp 75 of the optical fixing unit 70 provided downstream of the thermal head 7 is lighted up, thereby fixing the yellow layer 41 on the recording sheet 40 (step S102).

When the coloring and fixing of the yellow layer 41 is terminated and the leading end of the recording sheet 40 which has circulated once along the conveyance path 12 is again sensed by the sheet sensor 13, printing of the image in magenta starts. In this printing, the step motor 86 drives the platen roller 8 and the first and second conveyance rollers 10*a* and 11*a*, thereby conveying the recording sheet 40 in the predetermined direction along the ring-like conveyance path 12. Then, the thermal head 7 is driven, thereby coloring the magenta layer 42 on the recording sheet 40 with the magenta print data. Then, the lamp of the fixing unit 70 provided downstream of the thermal head 7 is lighted up, thereby fixing the magenta layer 42 on the recording sheet 40 (step S103).

When the coloring and fixing of the magenta layer 42 is terminated, the sheet exit gate 21 is opened (step S104). When the sheet sensor 13 again senses the leading end of the recording sheet 40 which has circulated once more along the conveyance path 12, the thermal head 7 is driven with the cyan print data, thereby coloring the cyan layer 43 on the recording sheet 40. Then, the recording sheet 40 is moved away from the conveyance path 12 and discharged out of the open sheet exit 19 by driving the platen roller 8 and the first and second conveyance rollers 10*a* and 11*a* (step S105).

Thus, according to the printer of the third embodiment, since the thermal head 7 and the optical fixing unit 70 are disposed within the inside of the ring-like conveyance path 12, the inside of the conveyance path 12 is used effectively, and the printer is reduced in size.

The recording sheet 30 is conveyed with its recording face facing the inside of the conveyance path 12 and with the back of the recording sheet facing the outside of the ring-like conveyance path 12. Thus, the recording sheet 30 bent along the ring-like conveyance path tends to unbend resiliently. Thus, the whole recording sheet face facing the inside of the ring-like conveyance path 12 is difficult to come into contact with the inner wall of the ring-like conveyance path 12, which prevents scratches or the like from being possibly produced. The recording sheet 30 is conveyed while being held between the drive rollers 10*a*, 11*a* and the follower rollers 10*b*, 11*b* provided respectively on the sides of the back and recording faces. Further, the conveyance drive force is applied to the back of the recording sheet 30. Thus, the recording face 30*c* also is protected from being scratched.

While in the recording sheet 40 used in the printer of the third embodiment the yellow and magenta layers are illustrated as optically fixed and the cyan layer are not, the cyan layer may be fixed optically by a cyan fixing lamp which may be provided in the optical fixing unit.

Various modifications and changes may be made thereunto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2006-241730 filed on Sep. 6, 2006 and including specification, claims, drawings and summary. The disclosure of the above Japanese patent application is incorporated herein by reference in its entirety.

What is claimed is:

1. A printer for printing on a first recording sheet and a second recording sheet, wherein each of the first and second recording sheets has identification information thereon to identify the recording sheet, and wherein the second recording sheet has a length longer than a length of the first recording sheet in a direction in which the first and second recording sheets are conveyed, the printer comprising:

a casing;

a first ring-like conveyance path provided within the casing and having a length corresponding to the length of the first recording sheet in the direction in which the first recording sheet is conveyed;

a second ring-like conveyance path provided within the casing and having a length corresponding to the length of the second recording sheet in the direction in which the second recording sheet is conveyed, wherein a part of the second conveyance path is shared with the first conveyance path;

a sensor which senses the identification information on the first or second recording sheet inserted into the printer;

a selector which selectively switches between the first conveyance path and the second conveyance path as a conveyance path selected for use, depending on at least one of (i) whether the first recording sheet or the second recording sheet is subject to printing, and (ii) the identification information sensed by the sensor;

a ribbon cassette receiving space where one of a first ribbon cassette and a second ribbon cassette is selectively loaded, the first ribbon cassette containing a multi-color ink ribbon with a plurality of different color ink areas which correspond in length to the first recording sheet and having cassette information thereon to identify the first cassette, and the second ribbon cassette containing a multi-color ink ribbon with a plurality of different color ink areas which correspond in length to the second recording sheet and having second cassette information thereon to identify the second cassette;

a cassette information sensor which senses the cassette information on the cassette loaded in the ribbon cassette receiving space;

a determiner which determines whether or not a combination of the recording sheet whose information is sensed by the sheet sensor and the cassette whose information is sensed by the cassette information sensor is proper;

an indicator which, responsive to a determination that the combination of the sheet and the cassette is proper, indicates which of the first and second conveyance paths should be selected;

a conveyance unit which conveys one of the first and second recording sheets such that (i) when the selector selects the first conveyance path to carry out printing on the first recording sheet, the conveyance unit conveys the first recording sheet with a recording face thereof facing an inside of the first conveyance path, such that the first recording sheet is conveyed in one direction in the first conveyance path in a circulating manner a plurality of times, and (ii) when the selector selects the second conveyance path to carry out printing on the second recording sheet, the conveyance unit conveys the second recording sheet with a recording face thereof facing an inside of the second conveyance path, such that the second recording sheet is conveyed in one direction in the second conveyance path in a circulating manner a plurality of times; and a printing unit which comprises a thermal head located within the part shared by the first and the second conveyance paths;

wherein, when the first recording sheet is sensed and is subject to printing, the printing unit drives the thermal head to sequentially print images on the recording face of the first recording sheet, which faces the inside of the first conveyance path, in a superimposed manner with the plurality of different color ink areas of the multi-color ink ribbon contained in the cassette such that a one-color image is printed on the first recording sheet for each of the plurality of times that the first recording sheet is conveyed in the one direction in the first conveyance path in the circulating manner, so as to thereby form a color image on the recording face of the first recording sheet; and wherein, when the second recording sheet is sensed and is subject to printing, the printing unit drives the thermal head to sequentially print images on the recording face of the second recording sheet, which faces the inside of the second conveyance path, in a superimposed manner with the plurality of different color ink areas of the multi-color ink ribbon contained in the cassette such that a one-color image is printed on the second recording sheet for each of the plurality of times that the second recording sheet is conveyed in the one direction in the second conveyance path in the circulating manner, so as to thereby form a color image on the recording face of the second recording sheet.

2. The printer of claim 1, wherein, when it is determined that the combination is proper, the selector automatically selects the appropriate one of the first and second conveyance paths for conveying the recording sheet based on the information sensed by the recording sheet sensor.

3. The printer of claim 1, further comprising:

a notifier which, responsive to a determination that the combination of the sheet and the cassette is not proper, notifies that the combination of the sheet and the cassette is not proper.

4. The printer of claim 1, further comprising an operating element which is manually operated to operate the selector to select one of the first and second conveyance paths.

5. The printer of claim 1, wherein the conveyance unit comprises a pair of rollers provided in a vicinity of the first and second conveyance paths for feeding the first and second recording sheets while holding the recording sheet being fed therebetween, the pair of rollers comprising:

a drive roller which is driven by a drive motor and provided on an opposite side of the first and second recording sheets from the recording faces; and a follower roller which is rotated by the drive roller and which abuts on the recording faces of the first and second recording sheets.

6. A printer for printing on a first recording sheet and a second recording sheet, wherein each of the first and second recording sheets has identification information thereon to identify the recording sheet, and wherein the second recording sheet has a length longer than a length of the first recording sheet in a direction in which the first and second recording sheets are conveyed, the printer comprising:

a casing;

a first ring-like conveyance path provided within the casing and having a length corresponding to the length of the first recording sheet in the direction in which the first recording sheet is conveyed;

a second ring-like conveyance path provided within the casing and having a length corresponding to the length of the second recording sheet in the direction in which the second recording sheet is conveyed, wherein a part of the second conveyance path is shared with the first conveyance path;

a sensor which senses the identification information on the first or second recording sheet inserted into the printer;

a selector which selectively switches between the first conveyance path and the second conveyance path as a conveyance path selected for use, depending on whether the first recording sheet or the second recording sheet is subject to printing;

a ribbon cassette which contains a multi-color ink ribbon with a plurality of different color areas and which is received in an inside of the first and second conveyance paths, the ribbon cassette having cassette information thereon to identify the ribbon cassette;

a cassette information sensor which senses the cassette information on the ribbon cassette;

a determiner which determines whether a combination of the recording sheet whose information is sensed by the sheet sensor and the cassette whose information is sensed by the cassette information sensor is proper;

an indicator which, responsive to a determination that the combination of the recording sheet and the ribbon cassette is proper, indicates which of the first and second conveyance paths should be selected;

a conveyance unit which conveys one of the first and second recording sheets such that (i) when the selector selects the first conveyance path to carry out printing on the first recording sheet, the conveyance unit conveys the first recording sheet with a recording face thereof facing an inside of the first conveyance path, such that the first recording sheet is conveyed in one direction in the first conveyance path in a circulating manner a plurality of times, and (ii) when the selector selects the second conveyance path to carry out printing on the second recording sheet, the conveyance unit conveys the second recording sheet with a recording face thereof facing an inside of the second conveyance path, such that the second recording sheet is conveyed in one direction in the second conveyance path in a circulating manner a plurality of times; and a printing unit which comprises a thermal head located within the part shared by the first and the second conveyance paths;

wherein, when the first recording sheet is subject to printing, the printing unit drives the thermal head to carry out printing on the recording face of the first recording sheet with the plurality of different color ink areas of the multi-color ink ribbon contained in the ribbon cassette such that a one-color image is printed on the first recording sheet for each of the plurality of times that the first recording sheet is conveyed in the one direction in the first conveyance path in the circulating manner, thereby forming a color image on the recording face of the first recording sheet; and wherein, when the second recording sheet is subject to printing, the printing unit drives the thermal head to carry out printing on the recording face of the second recording sheet with the plurality of different color ink areas of the multi-color ink ribbon contained in the cassette such that a one-color image is printed on the second recording sheet for each of the plurality of times that the second recording sheet is conveyed in the one direction in the second conveyance path in the circulating manner, thereby forming a color image on the recording face of the second recording sheet.

* * * * *